US007266317B2

(12) United States Patent
Okano

(10) Patent No.: US 7,266,317 B2
(45) Date of Patent: Sep. 4, 2007

(54) IMAGE FORMING APPARATUS AND POSITIONAL DEVIATION CORRECTION SYSTEM

(75) Inventor: Tetsuya Okano, Anjyou (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 195 days.

(21) Appl. No.: 11/061,458

(22) Filed: Feb. 22, 2005

(65) Prior Publication Data

US 2005/0191072 A1 Sep. 1, 2005

(30) Foreign Application Priority Data

Feb. 23, 2004 (JP) ..... 2004-046346

(51) Int. Cl.
*G03G 15/00* (2006.01)

(52) U.S. Cl. ..... 399/49; 399/301

(58) Field of Classification Search ..... 399/49, 399/301; 347/116

See application file for complete search history.

(56) References Cited

U.S. PATENT DOCUMENTS 6,134,022 A 10/2000 Yamamoto et al.
6,148,168 A * 11/2000 Hirai et al. ..... 399/301
6,335,747 B1 * 1/2002 Munakata ..... 347/116
6,456,311 B1 * 9/2002 Harush et al. ..... 347/116
6,553,906 B1 * 4/2003 Bucks et al. ..... 101/211

FOREIGN PATENT DOCUMENTS

| | | |
|---|---|---|
| JP | A-09-030053 | 2/1997 |
| JP | A-09-039294 | 2/1997 |
| JP | A-09-109453 | 4/1997 |
| JP | B2-3066761 | 5/2000 |
| JP | A-2003-029488 | 1/2003 |

* cited by examiner

*Primary Examiner*—David M. Gray
*Assistant Examiner*—Ryan Gleitz
(74) *Attorney, Agent, or Firm*—Oliff & Berridge, PLC

(57) ABSTRACT

An image forming apparatus for easily detecting occurrence of positional deviation and magnification deviation among images, even when the deviations are small. Reference patches, which are rectangular areas, in which a longitudinal direction is a sub-scanning direction, painted in magenta, are formed on paper using a first image forming device. A target patch constituted by rectangular unit patches arranged in the sub-scanning direction is formed on the left side of the reference patch. Another target patch constituted by rectangular unit patches arranged in the sub-scanning direction is formed on the right side of the reference patch. The more downward each of the unit patches are positioned at, the more to the right the unit patches are shifted.

20 Claims, 17 Drawing Sheets

IMAGE FORMING APPARATUS AND POSITIONAL DEVIATION CORRECTION SYSTEM

BACKGROUND OF THE INVENTION (i) Field of the Invention

The present invention relates to an image forming apparatus which detects occurrence of positional deviation and magnification deviation among images.

(ii) Background Art

There has been conventionally known an image forming apparatus which forms a color image using a plurality of image forming devices for forming images of each color. For example, a color laser printer is provided with four photoconductors. Toner images of magenta (M), cyan (C), yellow (Y), and black (Bk) are respectively formed on the four photoconductors. The four color toner images are superimposed and transferred onto an inter-transfer unit to form a toner image of four colors. The toner image of four colors is transferred onto a recording medium, so that a color image corresponding to the toner image of four colors is formed on the recording medium.

In such an image forming apparatus, due to errors in laser optics, used for exposure of the photoconductors, and errors in assembling the photoconductors, positional deviation and magnification deviation among the four color toner images may occur on the inter-transfer unit. Then, the positional deviation and magnification deviation among the four color toner images may also occur on the recording medium.

In order to correct the positional deviation and magnification deviation, there has been known an image forming apparatus which prints a reference line on the recording medium using one image forming device, prints a target line using another image forming device, and detects the positional deviation and magnification deviation between the images based on the deviations between the reference line and the target line (for example, see Publication of Unexamined Japanese Patent Application No. 9-109453). If the positional deviation and magnification deviation between the images are detected, the positional deviation and magnification deviation can be solved by correcting a laser scanning starting position and a scanning range used for exposure of the photoconductors.

SUMMARY OF THE INVENTION

However, in the aforementioned method, when the deviations between the reference line and the target line printed on the recording medium are relatively small, there is a problem in that confirming occurrence of the deviations is difficult. This is because in the above conventional method, comparison between the lines is performed.

An object of the present invention is to overcome the above described shortcomings of the prior art and to provide an image forming apparatus by which occurrence of positional deviation and magnification deviation between different color toner images can be easily detected, even when the deviations are relatively small.

To attain the above and other objects, there is provided an image forming apparatus including a first image forming device that forms an image using a first color toner and a second image forming device that forms an image using a second color toner, and a control device that controls the first image forming device and the second image forming device. The control device controls the first image forming device and the second image forming device, so that at least one reference patch whose specified area is painted in the first color toner is formed by the first image forming device and at least one target patch whose specified area is painted in the second color toner is formed by the second image forming device. A part of the reference patch and a part of the target patch are overlapped. A position where an overlap state between the reference patch and the target patch is changed varies in accordance with a change in a position in a first direction of a target patch forming position with respect to a reference patch forming position.

According to the present image forming apparatus, by detecting the position where the overlap state between the reference patch and the target patch is changed, occurrence of the positional deviation of the target patch in the first direction and the magnification deviation of the target patch with respect to the reference patch can be detected.

Specifically, according the present invention, occurrence of the positional deviation and magnification deviation is detected based on change in the state of overlapping area between the reference patch and the target patch having different colors. Thus, according to the present invention, compared to the conventional technique that detects occurrence of the positional deviation and magnification deviation between different color toner images based on a positional relationship between the reference line and the target line, occurrence of the positional deviation and magnification deviation can be easily detected. According to the present invention, a user can visually confirm occurrence of the positional deviation of the target patch in the first direction and the magnification deviation of the target patch with respect to the reference patch, so that occurrence of the positional deviation and magnification deviation between the different color toner images can be more easily detected than in the conventional technique.

The reference patch and the target patch are respectively formed by the first image forming device and the second image forming device. Therefore, the positional deviation of the target patch in the first direction and the magnification deviation of the target patch with respect to the reference patch correspond to the positional deviation and magnification deviation of the image formed by the second image forming device with respect to the image formed by the first image forming device.

Therefore, in the present invention, occurrence of the positional deviation and magnification deviation between the different color toner images can be more easily detected than in the conventional technique.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
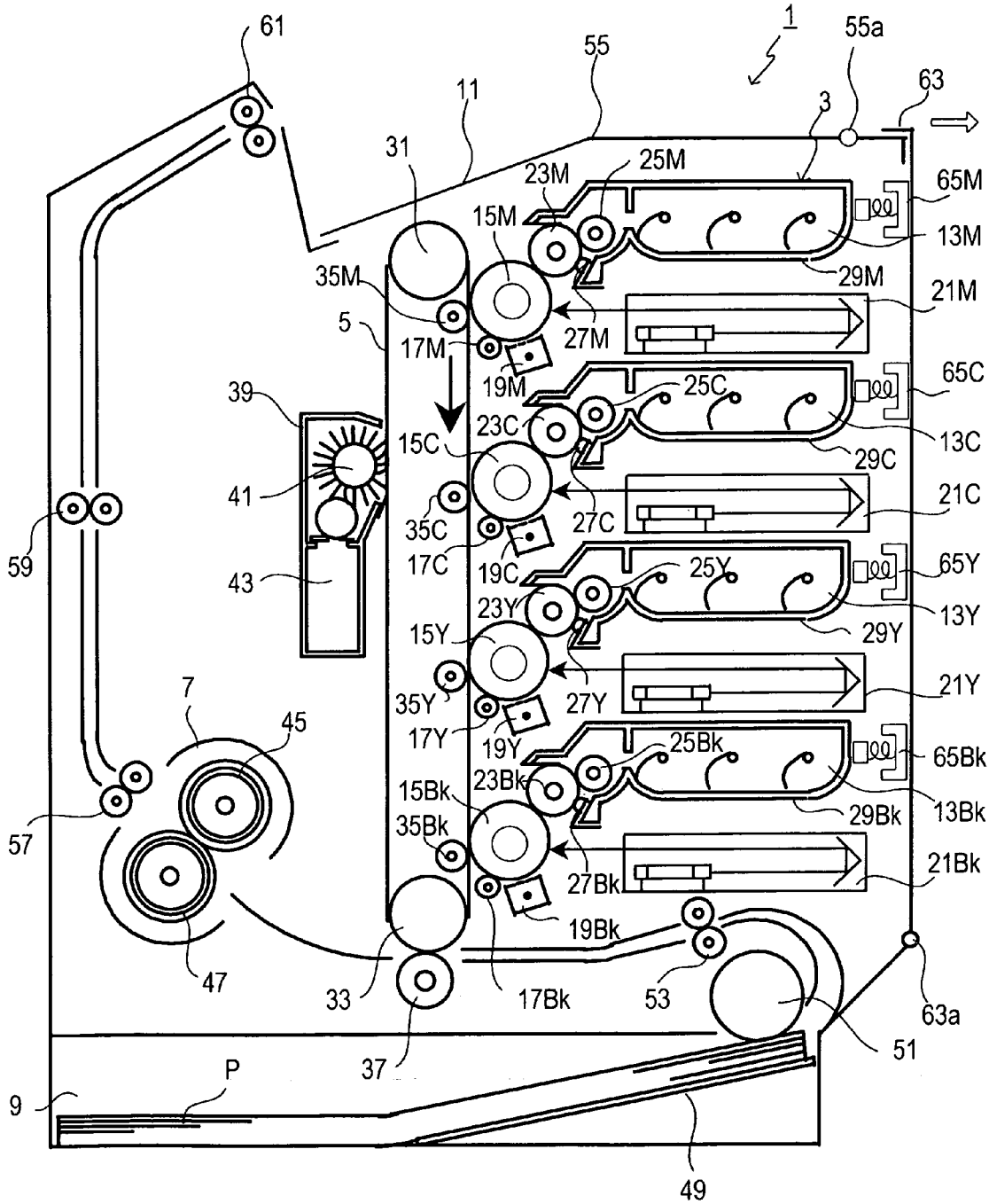
FIG. 1 is a sectional side view of a configuration of a color laser printer of an embodiment according to the invention.

The preferred embodiment of the present invention will be described below. A tandem color laser printer as an image forming apparatus will be described.

First Embodiment a) First, referring to FIG. 1, the configuration of a color laser printer 1 of the first embodiment, will be described.

The color laser printer 1 comprises a visible image forming unit 3, a belt shaped inter-transfer unit (ITB: Inter-Transfer Belt) 5, a fixing unit 7, a paper supply unit 9, and a paper discharge tray 11.

For visible image forming process by each of toners of magenta (M), cyan (C), yellow (Y), and Black (Bk), the visible image forming unit 3 comprises image developing units 13M, 13C, 13Y, and 13Bk as image developing devices, photoconductor drums 15M, 15C, 15Y, and 15Bk as photoconductors, cleaning rollers 17M, 17C, 17Y, and 17Bk, and charging units 19M, 19C, 19Y, and 19Bk, and exposing devices 21M, 21C, 21Y, and 21Bk.

Each of the components will be described more in details below. First, the image developing units 13M, 13C, 13Y, and 13Bk are respectively provided with developing rollers 23M, 23C, 23Y, and 23Bk. Each of the developing rollers 23M, 23C, 23Y, and 23Bk is cylindrically shaped and has a base material made of conductive silicone rubber, and a coat layer made of resin or rubber containing fluorine on the surface. The base material of each of the developing rollers 23M, 23C, 23Y, and 23Bk is not necessarily configured by conductive silicone rubber, but may be configured by conductive urethane rubber. The ten point height of irregularities (Rz) of the surface of each of the developing rollers 23M, 23C, 23Y, and 23Bk is set at 3 to 5 μm, which is smaller than the average grain diameter (9 μm) of toner.

The image developing units 13M, 13C, 13Y, and 13Bk are respectively provided with supply rollers 25M, 25C, 25Y, and 25Bk. The supply rollers 25M, 25C, 25Y, and 25Bk are conductive sponge rollers, and are disposed so as to abut and contact with the developing rollers 23M, 23C, 23Y, and 23Bk respectively due to elastic force of sponge. The supply rollers 25M, 25C, 25Y, and 25Bk may be made of appropriate foam such as conductive silicone rubber, EPDM rubber, or polyurethane rubber.

The image developing units 13M, 13C, 13Y, and 13Bk are respectively provided with layer thickness regulating blades 27M, 27C, 27Y, and 27Bk. The layer thickness regulating blades 27M, 27C, 27Y, 27Bk are provided with plate shaped base ends made of stainless steel or the like, and fixed to image developing unit casings 29M, 29C, 29Y, and 29Bk, respectively. The layer thickness regulating blades 27M, 27C, 27Y, 27Bk are provided with the distal ends made of insulated silicone rubber, insulated rubber with fluorine or resin. The distal ends of the layer thickness regulating blades 27M, 27C, 27Y, 27Bk abut the developing rollers 23M, 23C, 23Y, and 23Bk at the lower parts of the developing rollers 23M, 23C, 23Y, and 23Bk, respectively.

Toner contained in each of the image developing unit casings 29M, 29C, 29Y, and 29Bk is a positively charged single nonmagnetic developing agent. The toner contains a toner mother particle, whose average grain diameter is 9 μm. The toner mother particle can be obtained by adding a known coloring agent such as carbon black, and a charge control agent or a charge control resin such as nigrosine, triphenylmethane, quanternary ammonium salt to a spheral styrene acrylic resin formed by suspension polymerization. Silica is added to the surface of the toner mother particle as external additive, and the silica is hydrophobized using a conventional method by silane coupling agent or silicone oil. The average grain diameter of silica is 10 nm and added amount of the silica is 0.6 weight % of the toner mother particle. The toners of magenta, cyan, yellow, and black are respectively contained in the image developing unit casings 29M, 29C, 29Y, and 29Bk.

The toner is suspension polymerized toner having a shape significantly close to sphere. 0.6 weight % of hydrophobized silica, whose average grain diameter is 10 nm, is added to the toner as external additive. Therefore, the toner is superior in fluidity, and can be charged sufficiently by frictional charge. Furthermore, the toner is not angulated unlike a ground toner. Therefore, the toner is unlikely to receive mechanical force. The toner has an excellent following capability with respect to an electric field. High transfer efficiency is obtained by the toner.

Each of the photoconductor drums (OPC) 15M, 15C, 15Y, and 15Bk, is, for example, constituted by a base material made of aluminum and a positively-charged conductive layer formed on the base material. The thickness of the conductive layer is at least 20 μm. The base material made of aluminum is used as an earth layer.

Each of the cleaning rollers 17M, 17C, 17Y, and 17Bk is a roller constituted by elastic material such as conductive sponge. The cleaning rollers 17M, 17C, 17Y, and 17Bk are slidably contacted with the photoconductor drums 15M, 15C, 15Y, and 15Bk at the lower parts of the photoconductor drums 15M, 15C, 15Y, and 15Bk, respectively. A negative voltage, which is opposite to the voltage of the toner, is applied to each of the cleaning rollers 17M, 17C, 17Y, and 17Bk by a power source (not shown). Due to sliding force to the photoconductor drums 15M, 15C, 15Y, and 15M, and the influence of the electric field by the negative voltage through the cleaning rollers 17M, 17C, 17Y, and 17Bk, the toners on the inter-transfer unit 5 are reversely transferred onto the photoconductor drums 15M, 15C, 15Y, and 15Bk, and removed from the photoconductor drums 15M, 15C, 15Y, and 15Bk. In the present embodiment, so-called cleanerless developing method is adopted. In a certain process after an image development process, the remaining toners previously removed by the cleaning rollers 17M, 17C, 17Y, and 17Bk are returned to the sides of the photoconductor drums 16M, 15C, 15Y, and 15Bk, collected by the developing rollers 23M, 23C, 23Y, and 23Bk, and returned to the image developing units 13M, 13C, 13Y, and 13Bk (the image developing unit casings 29M, 29C, 29Y, and 29Bk).

The charging units 19M, 19C, 19Y, 19Bk are Scorotoron-type charging units. The charging units 19M, 19C, 19Y, 19Bk are disposed at downstream sides of the cleaning rollers 17M, 17C, 17Y, and 17Bk in the rotating directions of the photoconductor drums 15M, 15C, 15Y, and 15Bk. The charging units 19M, 19C, 19Y, 19Bk face the surfaces of the photoconductor drums 15M, 15C, 15Y, and 15Bk at the lower sides of the photoconductor drums 15M, 15C, 15Y, and 15Bk so that the charging units 19M, 19C, 19Y, and 19Bk are not in contact with the surfaces of the photoconductor drums 15M, 15C, 15Y, and 15Bk.

The exposing devices 21M, 21C, 21Y, and 21Bk are constituted by known laser scanner units. The exposing devices 21M, 21C, 21Y, and 21Bk are disposed so that the exposing devices 21M, 21C, 21Y, and 21Bk are vertically overlapped with the image developing units 13M, 13C, 13Y, and 13Bk of the visible image forming unit 3. The exposing devices 21M, 21C, 21Y, and 21Bk are disposed so that the exposing devices 21M, 21C, 21Y, and 21Bk are horizontally overlapped with the photoconductor drums 15M, 15C, 15Y, and 15Bk and the charging units 19M, 19C, 19Y, and 19Bk.

The exposing devices 21M, 21C, 21Y, and 21Bk expose the surfaces of the photoconductors 15M, 15C, 15Y, and 15Bk by laser beam at downstream sides of the charging units 19M, 19C, 19Y, and 19Bk in the rotating directions of the photoconductor drums 15M, 15C, 15Y, and 15Bk.

The laser beam in accordance with an image data is irradiated on each of the surfaces of the photoconductor drums 15M, 15C, 15Y, and 15Bk by the exposing devices 21M, 21C, 21Y, and 21Bk. Accordingly, an electrostatic latent image of each color is formed on the surface of each of the photoconductor drums 15M, 15C, 15Y, and 15Bk.

The toner is positively charged and supplied from each of the supply rollers 25M, 25C, 25Y, and 25Bk to each of the developing rollers 23M, 230, 23Y, and 23Bk. Uniformly thin toner layers are obtained by the layer thickness regulating blades 27M, 27C, 27Y, and 27Bk. At the contact parts between the developing rollers 23M, 23C, 23Y, and 23Bk, and the photoconductor drums 15M, 15C, 15Y, and 15Bk, the positively charged electrostatic latent images formed on the photoconductor drums 15M, 15C, 15Y, and 15Bk are reversely developed by the positively charged toners, so that high quality images can be formed.

The belt shaped inter-transfer unit 5 is formed by a conductive sheet made of polycarbonate or polyimide. As illustrated in FIG. 1, the belt shaped inter-transfer unit 5 is wound around two driving rollers 31 and 33. In the vicinities of the positions opposite to the photoconductor drums 15M, 16C, 15Y, and 15Bk, inter transfer rollers 35M, 35C, 35Y, and 35Bk are provided via the inter-transfer unit 5. The surface of the inter-transfer unit 5 on the side facing the photoconductor drums 15M, 15C, 15Y, and 15Bk moves in the vertical and downward direction as illustrated in FIG. 1.

A predetermined voltage is applied to each of the inter transfer rollers 35M, 35C, 36Y, and 35Bk, so that the toner images formed on the photoconductor drums 15M, 15C, 15Y, and 15Bk are transferred onto the inter-transfer unit 5. Also, a second transfer roller 37 is provided at a position where a toner image of four colors is transferred onto a paper P (corresponding to a recording medium), that is, a position opposed to a vertically lower part of the roller 33 with respect to the inter-transfer unit 5. A predetermined voltage is also applied to the second transfer roller 37. Consequently, the toner image of four colors carried on the belt shaped inter-transfer unit 5 is transferred onto the paper P.

As illustrated in FIG. 1, a cleaning unit 39 is provided on a side of the inter-transfer unit 5 opposite to the side facing the photoconductor drums 15M, 15C, 15Y, and 15Bk. The cleaning unit 39 includes a scratching member 41 and a case 43. The toner remaining on the inter-transfer unit 5 is scratched by the scratching member 41 and is collected in the case 43.

The fixing unit 7 includes a heating roller 45 and a pressure roller 47. The paper P carrying the toner image of four colors is heated and pressurized while sandwiched and conveyed between the heating roller 45 and the pressure roller 47, Thus, the toner image is fixed on the paper P.

The paper supply unit 9 is provided at the bottom of the apparatus (printer), and includes a container tray 49 for containing the paper P and a pick up roller 51 for sending out the paper P. The paper supply unit 9 supplies the paper P at a predetermined timing with respect to an image forming process performed by the exposing devices 21M, 21C, 21Y, and 21Bk, the image developing units 13M, 13C, 13Y, and 13Bk, the photoconductor drums 15M, 15C, 15Y, and 15Bk, and the inter-transfer unit 6. The paper P supplied from the paper supply unit 9 is conveyed by a pair of conveying rollers 53 to a contact and pressed part between the inter-transfer unit 5 and the second transfer roller 37.

At the top of the apparatus, a top surface cover 55 is provided in a rotatable manner around a shaft 55*a*. The paper discharge tray 11 is constituted by a part of the top surface cover 55. The paper discharge tray 11 is provided on a paper discharge side of the fixing unit 7, and collects the paper P, discharged from the fixing unit 7 and conveyed by pairs of conveying rollers 57, 59, and As illustrated in FIG. 1, a front surface cover 63 can be rotated around a shaft 63*a* in the arrow direction of FIG. 1. The image developing units 13M, 13C, 13Y, and 13Bk can be changed by opening the front surface cover 63. Spring members 65M, 65C, 65Y, 65Bk are provided at positions facing the image developing units 13M, 13C, 13Y, and 13Bk, on the front surface cover 63. When the front surface cover 63 is closed, the image developing units 13M, 13C, 13Y, and 13Bk are backwardly (in the left direction of FIG. 1) pressed by the spring members 65M, 65C, 65Y, and 65Bks, respectively.

Figure 2:
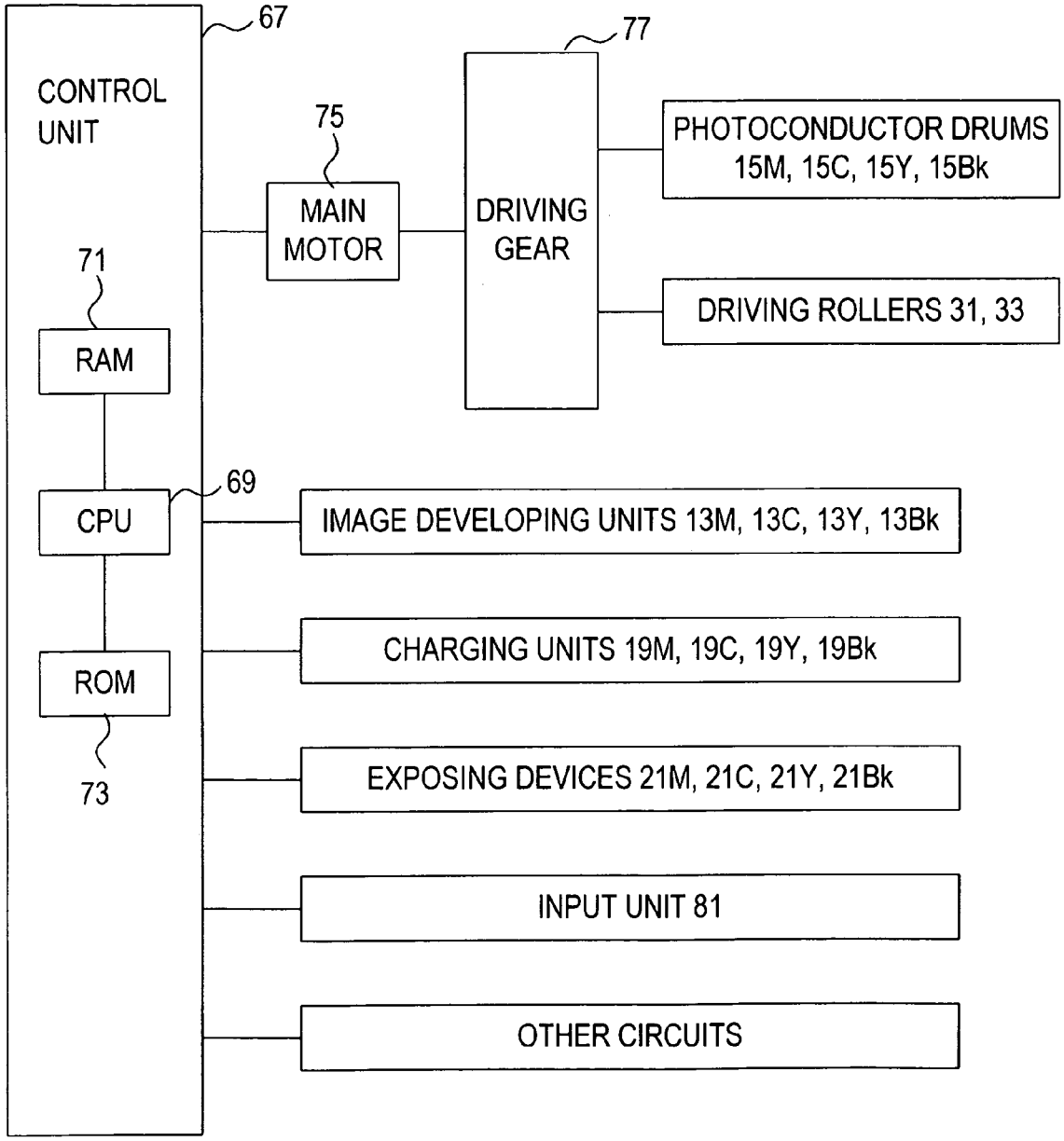
FIG. 2 is a block diagram of an electric configuration of the color laser printer.

As illustrated in FIG. 2, the color laser printer 1 has a control unit (control device) 67 including a CPU 69, a RAM 71, and a ROM 73.

The control unit 67 controls operation of a main motor 75. The main motor 75 is a motor that drives the photoconductor drums 15M, 15C, 15Y, and 15Bk, and the driving rollers 31 and 33 via a driving gear 77. Therefore, the control unit 67 controls the photoconductor drums 15M, 15C, 15Y, and 15Bk, and the driving rollers 31 and 33, via the main motor 75 and the driving gear 77.

Also, the control unit 67 controls operations of the image developing units 13M, 13C, 13Y, and 13Bk, the charging units 19M, 19C, 19Y, and 19Bk, and the exposing devices 21M, 21C, 21Y, and 21Bk. The color laser printer 1 is provided with an input unit 81 realized by a constitution having a touch panel or a keyboard. Information inputted through the input unit 81 is inputted in a recording unit such as the RAM 71 and stored.

b) Operation of the color laser printer 1 according to the aforementioned embodiment will be described. The photosensitive layers of the photoconductor drums 15M, 15C, 15Y, and 15Bk are uniformly charged by the charging units 19M, 19C, 19Y, and 19Bk, respectively.

The photosensitive layers of the photoconductor drums 15M, 15C, 15Y, and 15Bk are respectively exposed by the laser beam from the exposing devices 21M, 21C, 21Y, and 21Bk in accordance with image data. An electrostatic latent image corresponding to each color is formed on each of the photosensitive layers of the exposed photoconductor drums 15M, 15C, 15Y, and 15Bk.

Laser beam from each of the exposing devices 21M, 210, 21Y, and 21Bk is used for scanning over each of the photoconductor drums 15M, 15C, 15Y, and 15Bk with a predetermined scanning width in a main scanning direction (a direction perpendicular to the paper of FIG. 1). A starting position of the scanning is determined based on a position detected by a synchronous detection sensor (not shown).

Magenta toner, cyan toner, yellow toner, and black toner are respectively attached to the electrostatic latent images formed on the photosensitive layers of the photoconductor drums 15M, 15C, 15Y, and 15Bk by the magenta image developing unit 13M, the cyan image developing unit 13C, the yellow image developing unit 13Y, and the black image developing unit 13Bk, so that the images of magenta, cyan, yellow and black are developed. The thus formed toner images of magenta, cyan, yellow and black are once transferred onto the surface of the inter-transfer unit 5.

The toners remained on the photoconductor drums 15M, 15C, 15Y, and 15Bk after the toner transfer from the photoconductor drums 15M, 15C, 15Y, and 15Bk, to the inter-transfer unit 5, are temporarily retained by the cleaning rollers 17M, 17C, 17Y, and 17Bk. The toner image of each color is formed on each of the photoconductor drums 15M, 15C, 15Y, and 15Bk, with a slight time lag in accordance with a moving speed of the inter-transfer unit 5 and each of positions of the photoconductor drums 15M, 15C, 15Y, and 15Bk. The toner image of each color is transferred so that the toner image of each color is superimposed on the inter-transfer unit 5.

A toner image of four colors thus formed on the inter-transfer unit 5 is transferred onto the paper P supplied from the paper supply unit 9 at the contact and pressed part between the second transfer roller 37 and the inter-transfer unit 5. The toner image is fixed on the paper P at the fixing unit 7, and discharged on the paper discharge tray 11. Thus, a four-color image is formed.

c) In the color laser printer 1 according to the present embodiment, a method of correcting positional deviation and magnification deviation among four color toner images will be described.

In the color laser printer 1 according to the present embodiment, the four color toner images are respectively formed on the photoconductor drums 15M, 15C, 15Y, and 15Bk. The four color toner images are transferred onto the inter-transfer unit 5 and superimposed on the inter-transfer unit 5. Consequently, if there are optical errors in the exposing devices 21M, 21C, 21Y, and 21Bk, and errors in assembling the photoconductor drums 15M, 15C, 15Y, and 15Bk, the positional deviation and magnification deviation among the four color toner images occurs on the inter-transfer unit 5. If the four color toner images are thus transferred onto the paper P, the positional deviation and magnification deviation among the four color toner images occurs on the paper P.

In the color laser printer 1 of the present embodiment, the positional deviation and magnification deviation will be corrected as follows.

Figure 3:
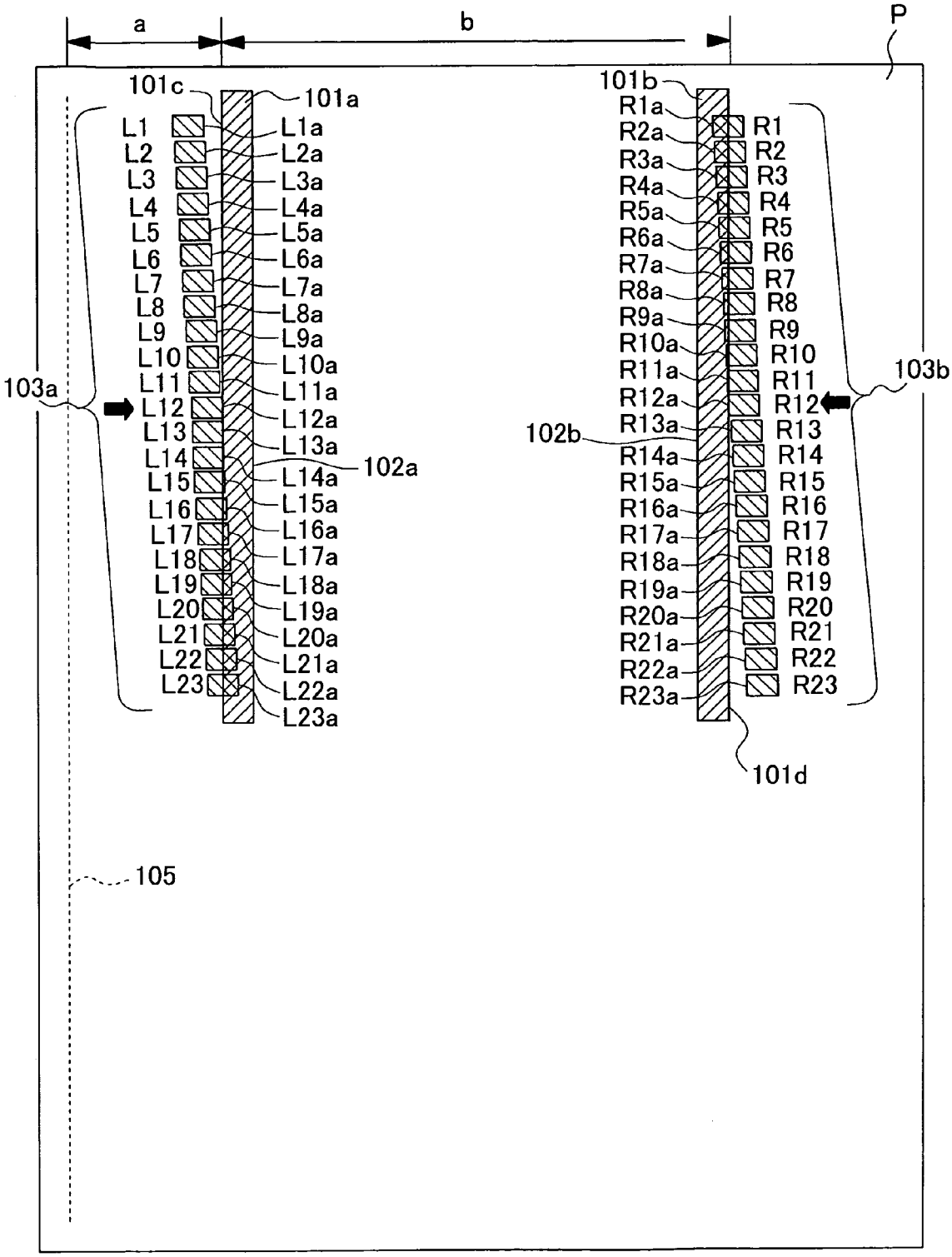
FIG. 3 is an explanatory view of reference patches and target patches.

First, as illustrated in FIG. 3, images of reference patches 101*a* and 101*b*, and target patches 103*a* and 103*b* are formed on the paper P.

The reference patches 101*a* and 101*b* are formed using the photoconductor drum 15M, the charging unit 19M, the exposing device 21M, and the magenta image developing unit 13M (the first image forming device) for forming a magenta color image. The reference patches 101*a* and 101*b* are rectangular area painted in magenta color. The reference patch 101*a* is formed on the left side of the paper P. The reference patch 101*b* is formed on the right side of the paper P. The longitudinal direction of the reference patches 101*a* and 101*b* are parallel to a sub-scanning direction (a direction perpendicular to a main scanning direction). Therefore, as illustrated in FIGS. 3, 4A, 4B, and 4C, a border section 101*c* (see FIG. 3), a left border line of the reference patch 101*a*, is a straight line parallel to the sub-scanning direction. A border section 101*d* (see FIG. 3), a right border line of the reference patch 101*b*, is also a straight line parallel to the sub-scanning direction. "a" (natural number) corresponding to the distance from the left end of the reference patch 101*a* to a print starting position 105 of the paper P is 1000 dots. "b" (natural number) corresponding to the distance from the left end of the reference patch 101*a* to the right end of the reference patch 101*b* is 3000 dots.

The target patches 103*a* and 103*b* are formed using the photoconductor drum 15C, the charging unit 19C, the exposing device 21C, and the cyan image developing unit 13C (the second image forming device) for forming a cyan color image. The target patch 103*a* is constituted by a plurality of rectangular unit patches L1 to L23, which are arranged on the left side of the reference patch 101*a* along the sub-scanning direction in downward order of L1, L2, L3 . . . L23. As illustrated in FIGS. 3, 4A, 4B, and 4C, border sections L1*a* to L23*a*, the right border lines of the unit patches L1 to L23, are straight lines parallel to the sub-scanning direction. The larger the reference number of each of the border sections L1*a* to L23*a* is (the more downward side each of the border sections L1*a* to L23*a* is positioned at), the more to the right by 1 dot each of the border sections L1*a* to L23*a* is shifted. That is, the border section L (i+1)a is shifted more to the right by 1 dot than the border section Lia. The "i" indicates integer numbers from 1 to 22.

The target patch 103*b* is constituted of a plurality of rectangular unit patches R1 to R23, which are arranged on the right side of the reference patch 101*b* along the sub-scanning direction in downward order of R1, R2, R3 . . . R23. Border sections R1*a* to R23*a*, the left border lines of the unit patches R1 to R23, are straight lines parallel to the sub-scanning direction. The larger the reference number of each of the border sections R1*a* to R23*a* is (the more downward side each of the border sections R1*a* to R23*a* is positioned at), the more to the right by 1 dot each of the border sections R1*a* to R23*a* is shifted.

The image data corresponding to the reference patches 101*a* and 101*b*, and the target patches 103*a* and 103*b* are stored in the ROM 73 (see FIG. 2) provided in the control unit 67. The control unit 67 controls the first image forming device and the second image forming device based on the image data in the ROM 73, and the reference patches 101*a* and 101*b*, and the target patches 103*a* and 103*b* are formed on the paper P by the control performed by the control unit 67.

Figure 4A:
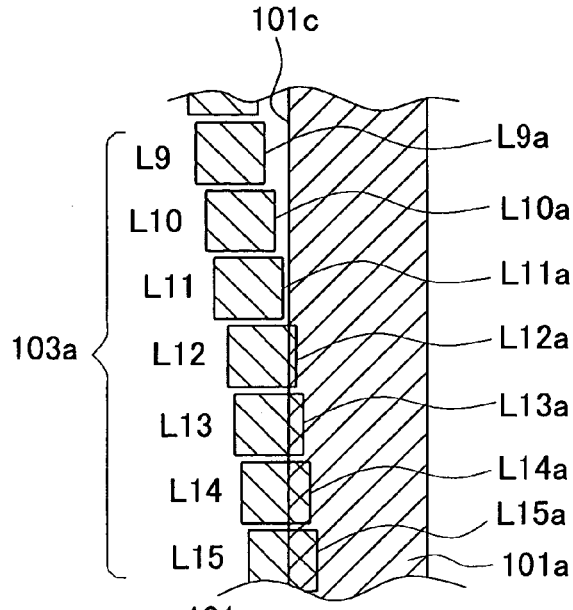
FIGS. 4A, 4B, and 4C are explanatory views of the reference patches and the target patches.

Some of the unit patches L1 to L23 of the target patch 103*a* overlap with the reference patch 101*a*. In the case of FIG. 4A, the border sections L1*a* to L11*a* at the right ends of the unit patches L1 to L11 are positioned on the left side of the border section 101*c*, the left end of the reference patch 101*a*. Therefore, the unit patches L1 to L11 do not overlap with the reference patch 101*a*. However, the border sections L12*a* to L23*a* at the right ends of the unit patches L12 to L23 are positioned on the right side of the border section 101*c*, the left end of the reference patch 101*a*. Therefore, the unit patches L12 to L23 overlap with the reference patch 101*a*. In this case, between the unit patches L11 and L12, the overlap state between the reference patch 101*a* and the target patch 103*a* is changed from a state in which the target patch 103*a* does not overlap with the reference patch 101*a* to a state in which the target patch 103*a* overlaps with the reference patch 101*a*.

Figure 4B:
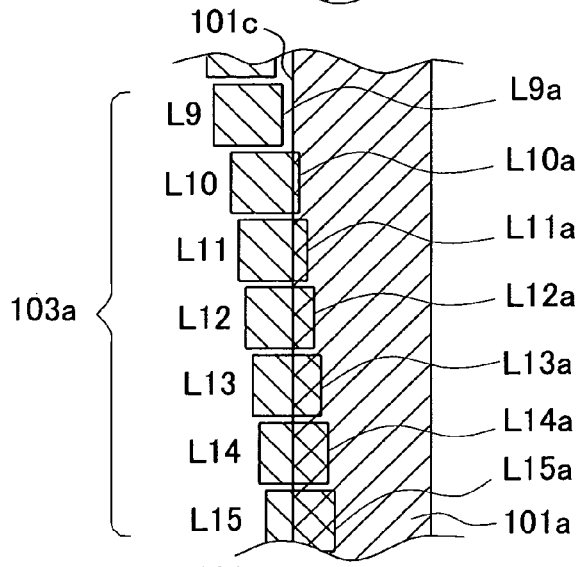

The position where the overlap state is changed varies in accordance with the position of the target patch 103*a* with respect to the position of the reference patch 101*a* in the main scanning direction. In the case of FIG. 4B, the target patch 103*a* is moved more to the right by 2 dots than in the case of FIG. 4A. In this case, the unit patches L1 to L9 of the target patch 103*a* do not overlap with the reference patch 101*a*. However, the unit patches L10 to L23 overlap with the reference patch 101*a*. That is, between the unit patches L9 and L10, the overlap state is changed from a state in which the target patch 103*a* does not overlap with the reference patch 101*a* to a state in which the target patch 103*a* overlaps with the reference patch 101*a*.

Figure 4C:
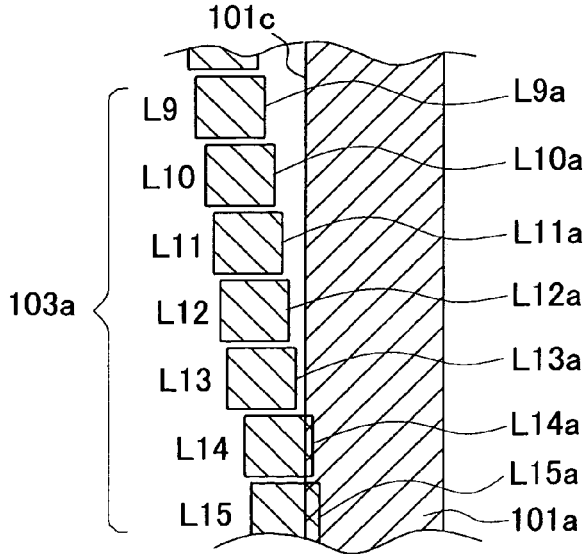

In the case of FIG. 4C, the target patch 103*a* is moved more to the left by 2 dots than in the case of FIG. 4A. In this case, the unit patches L1 to L13 of the target patch 103*a* do not overlap with the reference patch 101*a*. However, the unit patches L14 to L23 overlap with the reference patch 101*a*. That is, between the unit patches L13 and L14, the overlap state is changed from a state in which the target patch 103*a* does not overlap with the reference patch 101*a* to a state in which the target patch 103*a* overlaps with the reference patch 101*a*.

In FIGS. 4A, 4B, and 4C, the relationship between the reference patch 101*a* and the target patch 103*a* is described. The relationship between the reference patch 101*b* and the target patch 103*b* is the same as in the relationship between the reference patch 101*a* and the target patch 103*a*. Specifically, the position where the overlap state between the reference patch 101*b* and the target patch 103*b* is changed varies in accordance with the position of the target patch 103*b* with respect to the position of the reference patch 101*b* in the main scanning direction.

As described above, the position where the overlap state is changed varies in accordance with the positions of the target patches 103*a* and 103*b* with respect to the positions of the reference patches 101*a* and 101*b* in the main scanning direction. Accordingly, the positional deviation and magnification deviation between the magenta color image (i.e., the reference patches 101*a* and 101*b*) and the cyan color image (i.e., the target patches 103*a* and 103*b*) can be detected. The details will be described hereinafter.

The image illustrated in FIG. 3 is the image in which there is neither positional deviation nor magnification deviation between the magenta color image (i.e., the reference patches 101*a* and 101*b*) and the cyan color image (i.e., the target patches 103*a* and 103*b*). In the case of FIG. 3, the position where the overlap state of the target patch 103*a* is changed is between the unit patches L11 and L12. The position where the overlap state of the target patch 103*b* is changed is between the unit patches R12 and R13. Therefore, if the image illustrated in FIG. 3 is formed on the paper P, both the positional deviation and the magnification deviation are 0.

Figure 5:
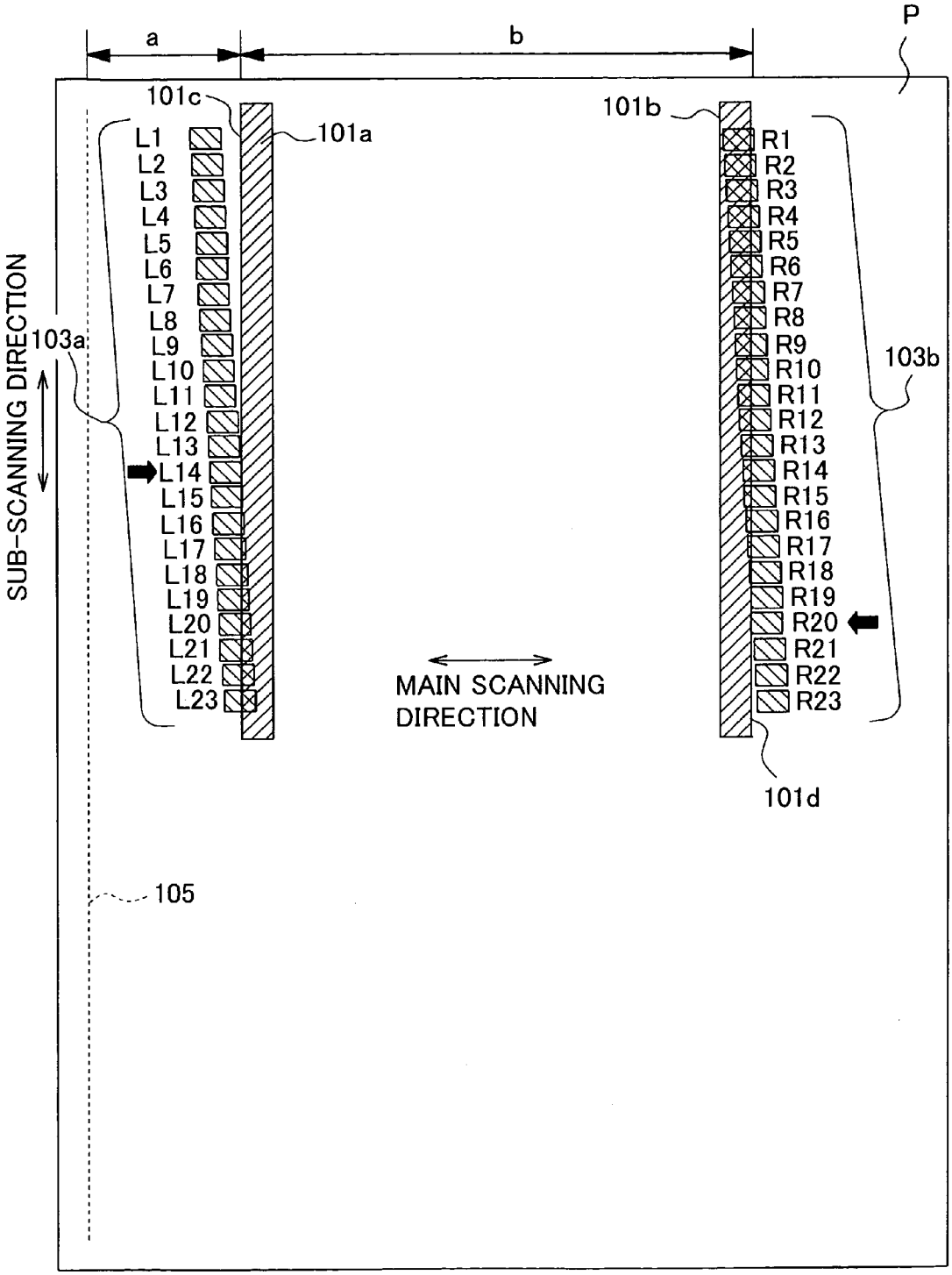
FIG. 5 is an explanatory view of a detection method of positional deviation and magnification deviation using the reference patches and the target patches.

In the case of FIG. 5, the position where the overlap state of the target patch 103*a* is changed, is between the unit patches L13 and L14. Compared with the case of FIG. 3 in which the overlap state of the target patch 103*a* is changed between the unit patches L11 and L12, the position where the overlap state is changed is downwardly shifted by 2 unit patches. As described above, the more downward side each of the positions of the border sections L1*a* to L23*a* is positioned at, the more to the right by 1 dot each of the border sections L1*a* to L23*a* at the right ends of the unit patches L1 to L23 is shifted. Therefore, if the position where the overlap state is changed is downwardly shifted by 2 unit patches, the target patch 103*a* is shifted more to the left by 2 dots along the main scanning direction with respect to the reference patch 101*a* than in the case of FIG. 3.

In the case of FIG. 5, the position where the overlap state of the target patch 103*b* is changed, is between the unit patches R20 and R21. Compared with the case of FIG. 3 in which the overlap state of the target patch 103*b* is changed between the unit patches R12 and L13, the position where the overlap state is changed is downwardly shifted by 8 unit patches. As described above, the more downward side each of the border sections R1*a* to R23*a* is positioned at, the more to the right by 1 dot each of the border sections R1*a* to R23*a* at the left ends of the unit patches R1 to R23 is shifted. Therefore, if the position where the overlap state is changed is downwardly shifted by 8 unit patches, the target patch 103*b* is shifted more to the left by 8 dots along the main scanning direction with respect to the reference patch 101*b* than in the case of FIG. 3.

The target patch 103*a* is shifted to the left by 2 dots, and the target patch 103*b* is shifted to the left by 8 dots. Therefore, the distance between the target patches 103*a* and 103*b* is 6 dots shorter than in the case of FIG. 3. As described above, "b" corresponding to the distance between the target patches 103*a* and 103*b* is 3000 dots. Therefore, in the case of FIG. 5, the size of the target patches 103*a* and 103*b* is reduced by 0.2%(=(6/3000)×100).

Since the size of the target patches 103*a* and 103*b* is reduced by 0.2%, the target patch 103*a* has approached the print starting position 105. In order to cancel the influence of the reduction in size, the target patch 103*a* should be moved to the right by 2 dots. The 2 dots corresponds to the calculation result in which a=1000 dots, corresponding to the distance between the print starting position 105 and the target patch 103*a*, is multiplied by the reduction ratio of 0.2%. Then, the position where the overlap state of the target patch 103*a* with respect to the reference patch 101*a* is changed, is moved to the position between the unit patches L11 and L12. Since this position is the same as the position in FIG. 3, it is found that no positional deviation in the main scanning direction occurs in the case of FIG. 5.

In summary, in the case where the reference patches 101*a* and 101*b* and the target patches 103*a* and 103*b* are formed as illustrated in FIG. 5, no positional deviation of the target patches 103*a* and 103*b* (i.e., the cyan color image) occurs with respect to the reference patches 101*a* and 101*b* (i.e., the magenta color image) in the main scanning direction. The magnification deviation of the target patches 103*a* and 103*b* with respect to the reference patches 101*a* and 101*b* is −0.2%.

Figure 6:
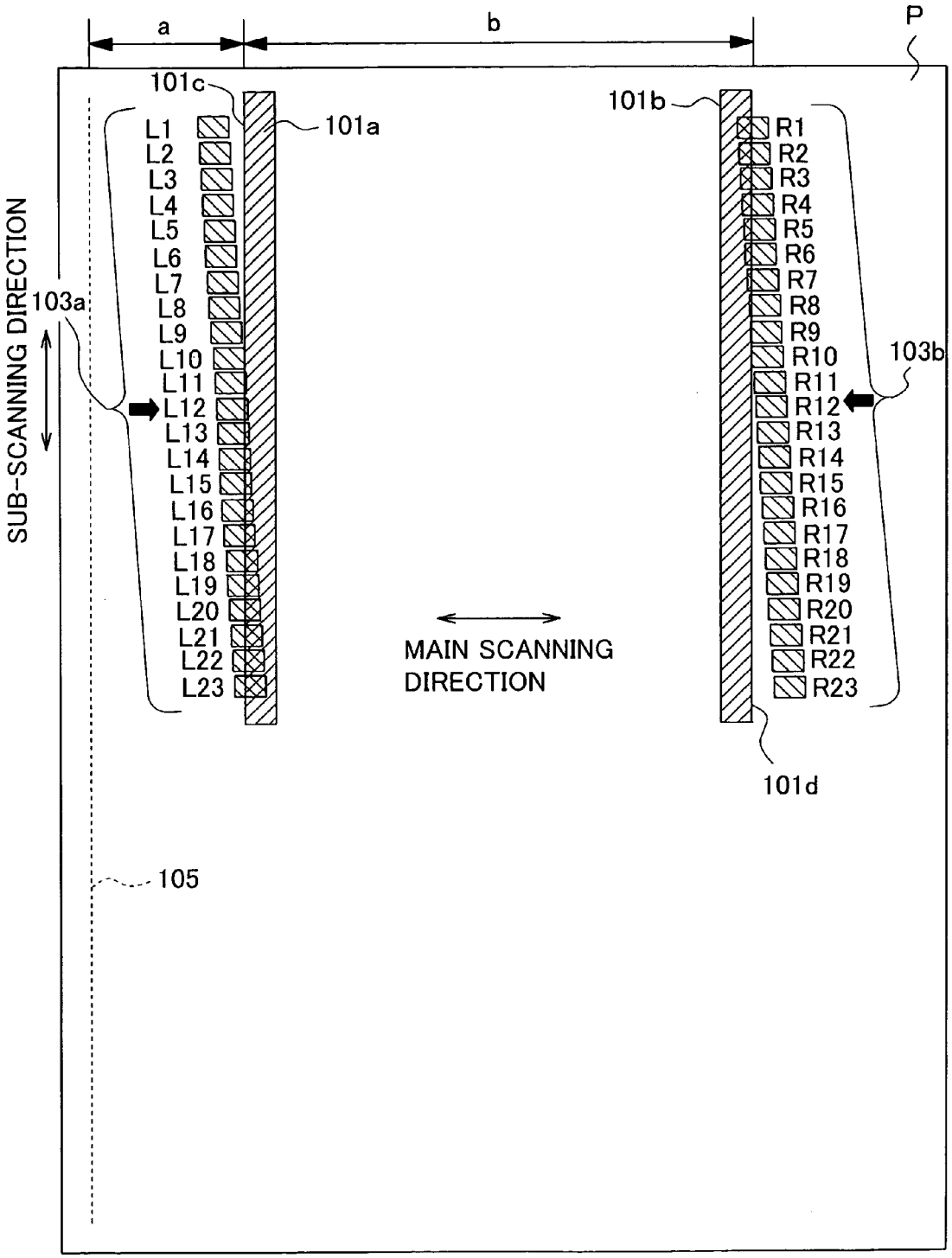
FIG. 6 is an explanatory view of the detection method of positional deviation and magnification deviation using the reference patches and the target patches.

In the case of FIG. 6, the position where the overlap state of the target patch 103*a* is changed, is between the unit patches L9 and L10. Compared with the case of FIG. 3 in which the overlap state of the target patch 103*a* is changed between the unit patches L11 and L12, the position where the overlap state is changed is upwardly shifted by 2 unit patches. As described above, the more downward side each of the border sections L1*a* to L23*a* at the right sides of the unit patches L1 to L23 is positioned at, the more to the right by 1 dot each of the border sections L1*a* to L23*a* is shifted. Therefore, if the position where the overlap state is changed is upwardly shifted by 2 unit patches, the target patch 103*a* is shifted more to the right by 2 dots along the main scanning direction with respect to the reference patch 101*a* than in the case of FIG. 3.

Also, in the case of FIG. 6, the position where the overlap state of the target patch 103*b* is changed, is between the unit patches R10 and R11. Compared with the case of FIG. 3 in which the overlap state of the target patch 103*b* is changed between the unit patches R12 and R13, the position where the overlap state is changed is upwardly shifted by 2 unit patches. As described above, the more downward side each of the border sections R1*a* to R23*a* at the left ends of the unit patches R1 to R23 is positioned at, the more to the right by 1 dot each of the border sections R1*a* to R23*a* is shifted. Therefore, if the position where the overlap state is changed is upwardly shifted by 2 unit patches, the target patch 103*b* is shifted more to the right by 2 dots along the main scanning direction with respect to the reference patch 101*b* than in the case of FIG. 3.

The target patch 103*a* is shifted more to the right by 2 dots than in the case of FIG. 3 and the target patch 103*b* is shifted more to the right by 2 dots than in the case of FIG. 3. Therefore, the distance between the target patches 103*a* and 103*b* is the same as that in the case of FIG. 3. There is no magnification deviation of the target patches 103*a* and 103*b* in the case of FIG. 5.

Since there is no magnification deviation as described above, the value obtained as described above corresponds to the positional deviation of the target patches 103*a* and 103*b*. Therefore, the positional deviation of the target patches 103*a* and 103*b* with respect to the reference patches 101*a* and 101*b* is 2 dots to the right.

In summary, in the case where the reference patches 101*a* and 101*b* and the target patches 103*a* and 103*b* are formed as illustrated in FIG. 6, the positional deviation of the target patches 103*a* and 103*b* (i.e., the cyan color image) with respect to the reference patches 101*a* and 101*b* (i.e., the magenta color image) in the main scanning direction is 2 dots to the right. There is no magnification deviation of the target patches 103*a* and 101*b* with respect to the reference patches 101*a* and 101*b*.

Figure 7:
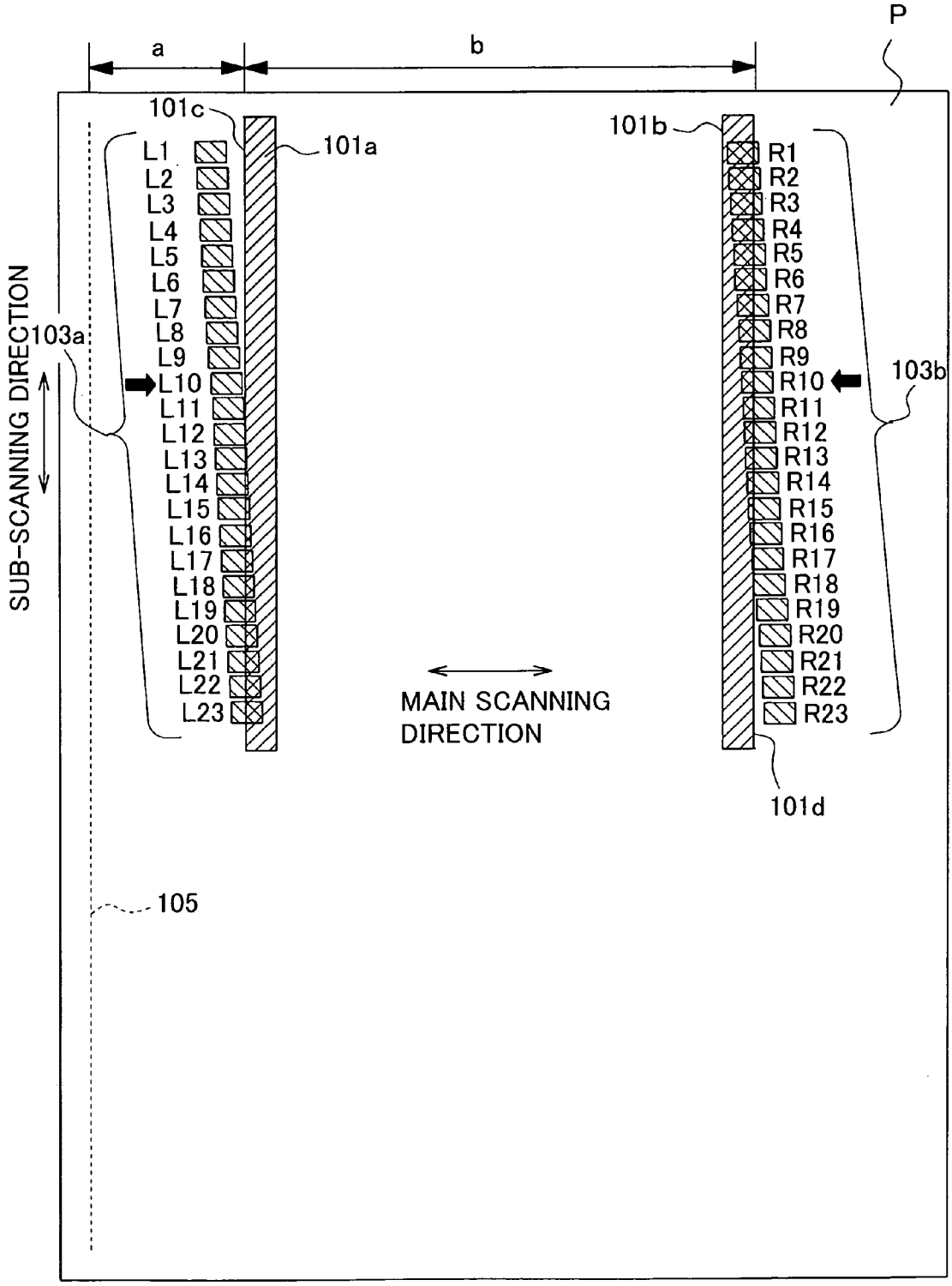
FIG. 7 is an explanatory view of the detection method of positional deviation and magnification deviation using the reference patches and the target patches.

In the case of FIG. 7, the position where the overlap state of the target patch 103*a* is changed, is between the unit patches L11 and L12, which is the same as in the case of FIG. 3. Therefore, the position of the target patch 103*a* with respect to the reference patch 101*a* is the same as in the case of FIG. 3.

In the image illustrated in FIG. 7, the position where the overlap state of the target patch 103*b* is changed, is between the unit patches R18 and R19. Compared with the case of FIG. 3 in which the overlap state of the target patch 103*b* is changed between the unit patches R12 and R13, the position where the overlap state is changed is downwardly shifted by 6 unit patches. As described above, the more downward side each of the border sections R1*a* to R23*a* at the left sides of the unit patches R1 to R23 is positioned at, the more to the right by 1 dot each of the border sections R1*a* to R23*a* is shifted. Therefore, if the position where the overlap state is changed is downwardly shifted by 6 unit patches, the target patch 103*b* is shifted more to the left by 6 dots along the main scanning direction with respect to the reference patch 101*b* than in the case of FIG. 3.

The target patch 103*a* is at the same position as in the case of FIG. 3 and the target patch 103*b* is shifted more to the left by 6 dots than in the case of FIG. 3. Therefore, the distance between the target patches 103*a* and 103*b* is 6 dots shorter than in the case of FIG. 3. As described above, "b" corresponding to the distance between the target patches 103*a* and 103*b* is 3000 dots. Therefore, the size of the target patches 103*a* and 103*b* is reduced by 0.2%(=(6/3000)×100).

Since the size of the target patches 103*a* and 103*b* is reduced by 0.2%, the target patch 103*a* has approached the print starting position 105. In order to cancel the influence of the reduction in size, the target patch 103*a* should be moved to the right by 2 dots. The 2 dots corresponds to the calculation result in which a=1000 dots, corresponding to the distance between the print starting position 103 and the target patch 103*a*, is multiplied by the reduction ratio of 0.2%. Then, the position where the overlap state of the target patch 103*a* with respect to the reference patch 101*a* is changed, is moved to the position between the unit patches L9 and L10. This position is a position shifted more to the right by 2 dots than in the case of FIG. 3.

In summary, in the case where the reference patches 101*a* and 101*b* and the target patches 103*a* and 103*b* are formed as illustrated in FIG. 7, the positional deviation of the target patches 103*a* and 103*b* (i.e., the cyan color image) with respect to the reference patches 101*a* and 101*b* (i.e., the magenta color image) in the main scanning direction is 2 dots to the right. The magnification deviation of the target patches 103*a* and 103*b* with respect to the reference patch 101*a* and 101*b* is −0.2%.

According to the present color laser printer 1, as described above, a user can detect occurrence of the positional deviation and magnification deviation among the different color images using the reference patches 101*a* and 101*b* and the target patches 103*a* and 103*b* formed on the paper P. Also, the user can quantitatively detect each of the positional deviation and magnification deviation. The user can input the detected value of the positional deviation and magnification deviation in the input unit 81. The control unit 67 of the color laser printer 1 corrects the first image forming device and the second image forming device so as to solve the positional deviation and magnification deviation based on the inputted value.

The user may input information indicating a position where the overlap state of the target patch 103*a* is changed, and information indicating a position where the overlap state of the target patch 103*b* is changed, in the input unit 81. In this case, by the aforementioned method, the control unit 67 quantitatively detects each of the positional deviation and magnification deviation among the different color images based on the information inputted in the input unit 81.

d) Effect achieved by the color laser printer 1 in the present embodiment will be described.

According to the present color laser printer 1, occurrence of positional deviation and magnification deviation among different color images can be detected based on change in the state of overlapping area between the reference patches 101*a* and 101*b*, and the target patches 103*a* and 103*b*, the reference patches and the target patches having different colors. Also, each of the positional deviation and magnification deviation can be quantitatively detected. Therefore, according to the present invention, the positional deviation and magnification deviation among different color toner images can be more easily detected than in the conventional technique that detects the positional deviation and magnification deviation based on a positional relationship between a reference line and a target line.

Specifically, according to the present embodiment, the user can visually confirm occurrence of the positional deviation and magnification deviation of the target patches 103*a* and 103*b* with respect to the reference patches 101*a* and 101*b* in the main scanning direction and these quantitative values. Therefore, in the present invention, occurrence of the positional deviation and magnification deviation and these quantitative values can be more easily detected than in the conventional technique.

If positions and magnification among the different color images are corrected based on the positional deviation in the main scanning direction and the magnification deviation of the target patches 103*a* and 103*b* with respect to the reference patches 101*a* and 101*b* as described above, the positional deviation in the main scanning direction and the magnification deviation among the different color images can be reduced.

ii) In the color laser printer 1 of the present embodiment, a pair of the reference patch 101*a*, and the target patch 103*a* corresponding to the reference patch 101*a*, are formed on the left side of the paper P. A pair of the reference patch 101*b*, and the target patch 103*b* corresponding to the reference patch 101*b*, are formed on the right side of the paper P. In each pair of the two pairs, the positional deviation among the different color images is detected. Based on the detection result, the magnification deviation of the image formed by the color of the target patches 103*a* and 103*b* with respect to the image formed by the color of the reference patches 101*a* and 101*b* can be calculated.

iii) In the color laser printer 1 of the present embodiment, a position where an overlap state between the reference patch 101*a* and the target patch 103*a* is changed, is determined at the border section 101*c* as an outside border line (on a side opposite to the reference patch 101*b*) of the reference patch 101*a*. Also, a position where an overlap state between the reference patch 101*b* and the target patch 103*b* is changed, is determined at the border section 101*d* as an outside border line (on a side opposite to the reference patch 101*a*) of the reference patch 101*b* (see FIG. 3). The distance "b" between the border section 101 of the reference patch 101*a* and the border section 101*d* of the reference patch 101*b* is longer than the distance between a border section 102*a* of the reference patch 101*a* on a Bide facing the reference patch 101*b* and a border section 102*b* of the reference patch 101*b* on a side facing the reference patch 101*a* (see FIG. 3). Therefore, if the magnification deviation of the target patches 103*a* and 103*b* with respect to the reference patches 101*a* and 101*b* is existent and the border sections 101*c* and 101*d* are used for the detection thereof as in the present embodiment, the detected deviation value itself becomes larger than in the case where the border sections 102*a* and 102*b* are used for the detection. Consequently, the magnification deviation can be calculated precisely.

iv) In the present color laser printer 1, the border sections 101*c* and 101*d* of the reference patches 101*a* and 101*b* are straight lines parallel to the sub-scanning direction. Also, the border sections L1*a* to L23*a* and R1*a* to R23*a* of the target patches 103*a* and 103*b* are straight lines parallel to the sub-scanning direction. Therefore, the positions where the overlap states of the reference patches 101*a* and 101*b* with respect to the target patches 103*a* and 103*b* are changed, can be detected precisely, and the positional deviation and magnification deviation can be calculated precisely.

Second Embodiment

Figure 8:
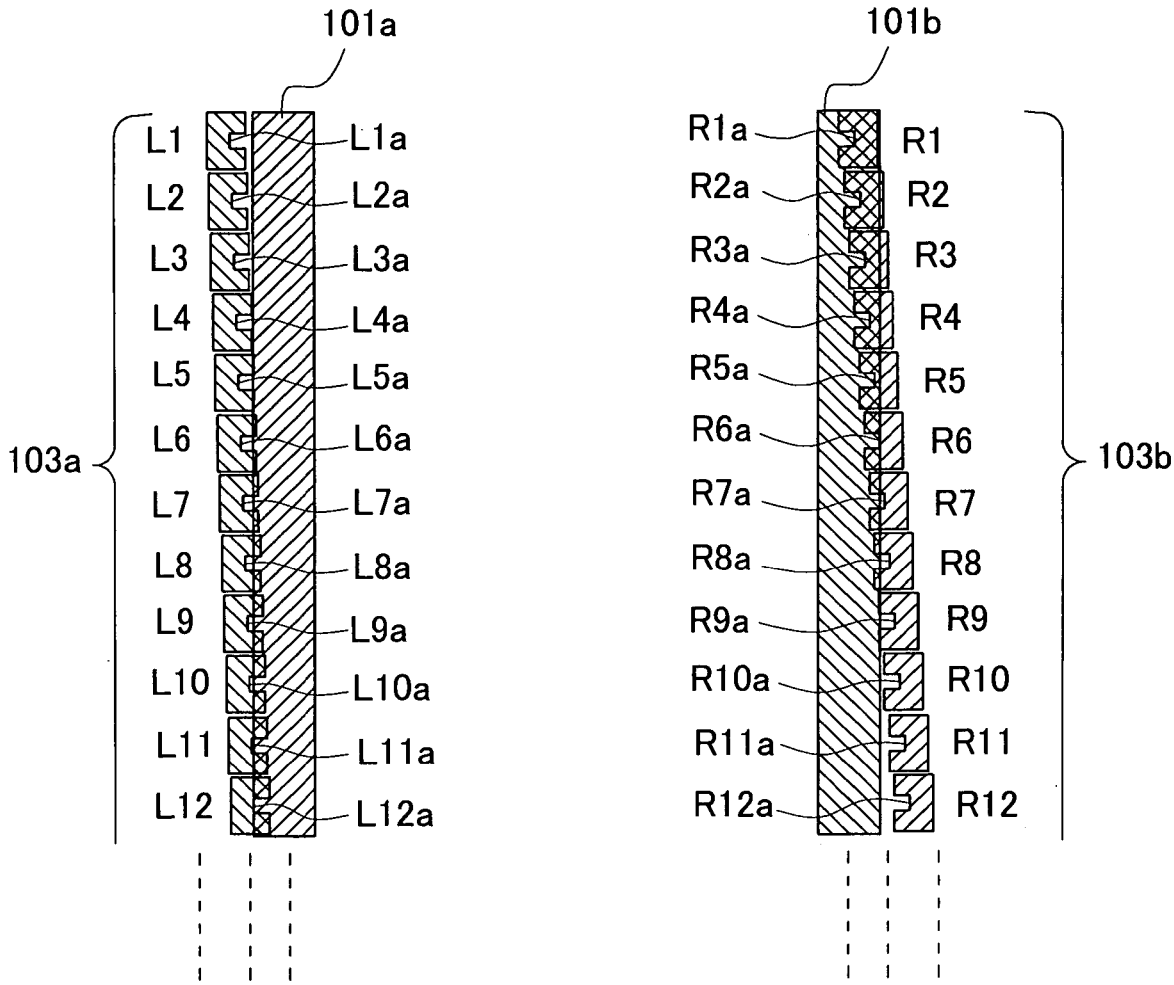
FIG. 8 is an explanatory view of reference patches and target patches.

The constitution and operation of the color laser printer in the second embodiment is basically the same as in the first embodiment. However, as illustrated in FIG. 8, the target patch 103*a* is constituted of a plurality of U-shaped unit patches L1 to L23. Each of the unit patches L1 to L23 is provided with a concave portion, whose depth direction is parallel to the main scanning direction, on the right side surface of each of the unit patches L1 to L23 (on a side located adjacent to the reference patch 101*a*). The bottom part of the concave portion is defined as each of the border sections L1*a* to L23*a* which are straight lines parallel to the sub-scanning direction. The larger the reference number of each of the border sections L1*a* to L23*a* is, the more to the right by 1 dot each of the border sections L1*a* to L23*a* is shifted. That is, the border section L(i+1)a at the right end of the unit patch L(i+1) is shifted more to the right by 1 dot than the border section Lia at the right end of the unit patch Li. The "i" indicates integer numbers from 1 to 22.

Similarly, as illustrated in FIG. 8, the target patch 103*b* is constituted of a plurality of U-shaped unit patches R1 to R23. Each of the unit patches R1 to R23 is provided with a concave portion, whose depth direction is parallel to the main scanning direction, on the left side surface of each of the unit patches R1 to R23. The bottom part of the concave portion is defined as each of the border sections R1*a* to R23*a* which are straight lines parallel to the sub-scanning direction. The larger the reference number of each of the border sections R1*a* to R23*a* is, the more to the right by 1 dot each of the border sections R1*a* to R23*a* is shifted.

Figure 9A:
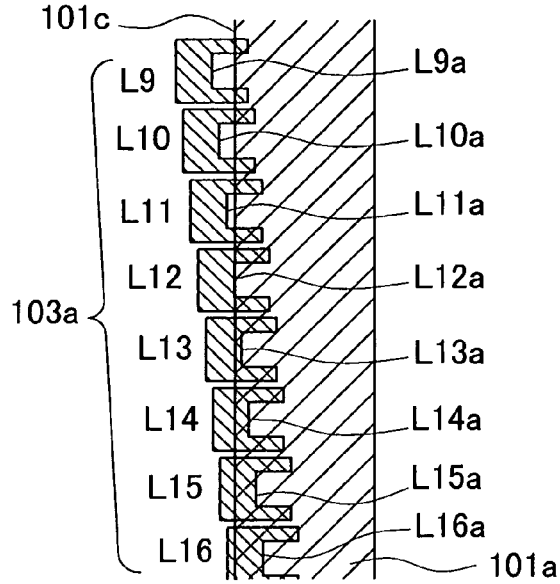
FIGS. 9A, 9B, and 9C are explanatory views of a detection method of positional deviation and magnification deviation using the reference patches and the target patches.
Figure 9B:
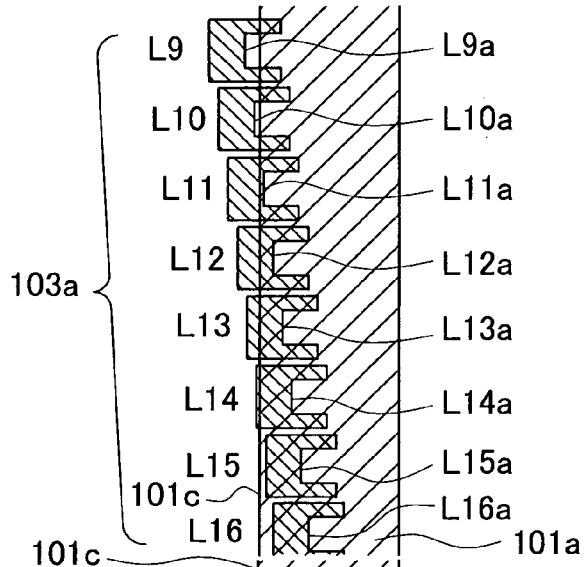
Figure 9C:
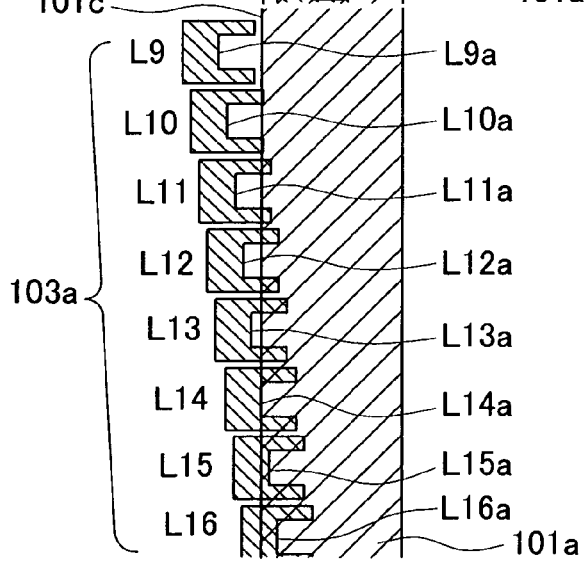

In the second embodiment, a change in the overlap state between the reference patch 101*a* and the target patch 103*a* will be described with reference to FIGS. 9A, 9B, and 9C. In the case of FIG. 9A, the border sections L1*a* to L11*a* as the bottom parts of the concave portions in the unit patches L1 to L11 of the target patch 103*a*, are located on the left side of the border section 101*c* at the left end of the reference patch 101*a*. Therefore, areas which are not painted in the reference patch 101*a* are remained in the concave portions in the unit patches L1 to L11.

Conversely, the border sections L12*a* to L23*a* as the bottom parts of the concave portions in the unit patches L12 to L23 are located at a position contacted with the border section 101*c* at the left end of the reference patch 101*a* or at a position on the right side of the border section 101*c*. Therefore, all of the concave portions in the unit patches L12 to L23 are painted in cyan color which is the color of the reference patch 101*a*.

Therefore, in the case of FIG. 9A, the overlap state is changed between the unit patch L11 in which some area of the concave portion is not painted in any color, and the unit patch L12 in which all area of the concave portion is painted in the color of the reference patch 101*a*.

Similarly, in the case of FIG. 5B, the overlap state is changed between the unit patches L10 and L11. In the case of FIG. 9C, the overlap state is changed between the unit patches L13 and L14.

In the second embodiment, change in the overlap state between the reference patch 101*a* and the target patch 103*a* can be determined by determining whether or not an area which is not painted in the color of the reference patch 101*a* is remained within the concave portion in each of the U-shaped unit patches L1 to L23 of the unit patch 103*a*.

Also, change in the overlap state between the reference patch 101*b* and the target patch 103*b* can be determined by determining whether or not an area which is not painted in the color of the reference patch 101*b* is remained within the concave portion in each of the U-shaped unit patches R1 to R23 of the unit patch 103*b*. For example, in the case of FIG. 8, the overlap state is changed between the unit patch R6 in which all area of the concave portion is painted in the color of the reference patch 101*b*, and R7 in which some area of the concave portion is not painted in any color. Therefore, a position between the unit patches R6 and R7 can be detected as a position where the overlap state is changed.

Thus, according to the present embodiment, the user can visually determine a position where the overlap state between the reference patch 101*a* and the target patch 103*a* is changed, and a position where the overlap state between the reference patch 101*b* and the target patch 103*b* is changed.

Therefore, by using the determination result, as in the case of the first embodiment, the positional deviation and magnification deviation among the different color images can be detected, and each of the positional deviation and magnification deviation can be quantitatively detected.

Third Embodiment

Figure 10:
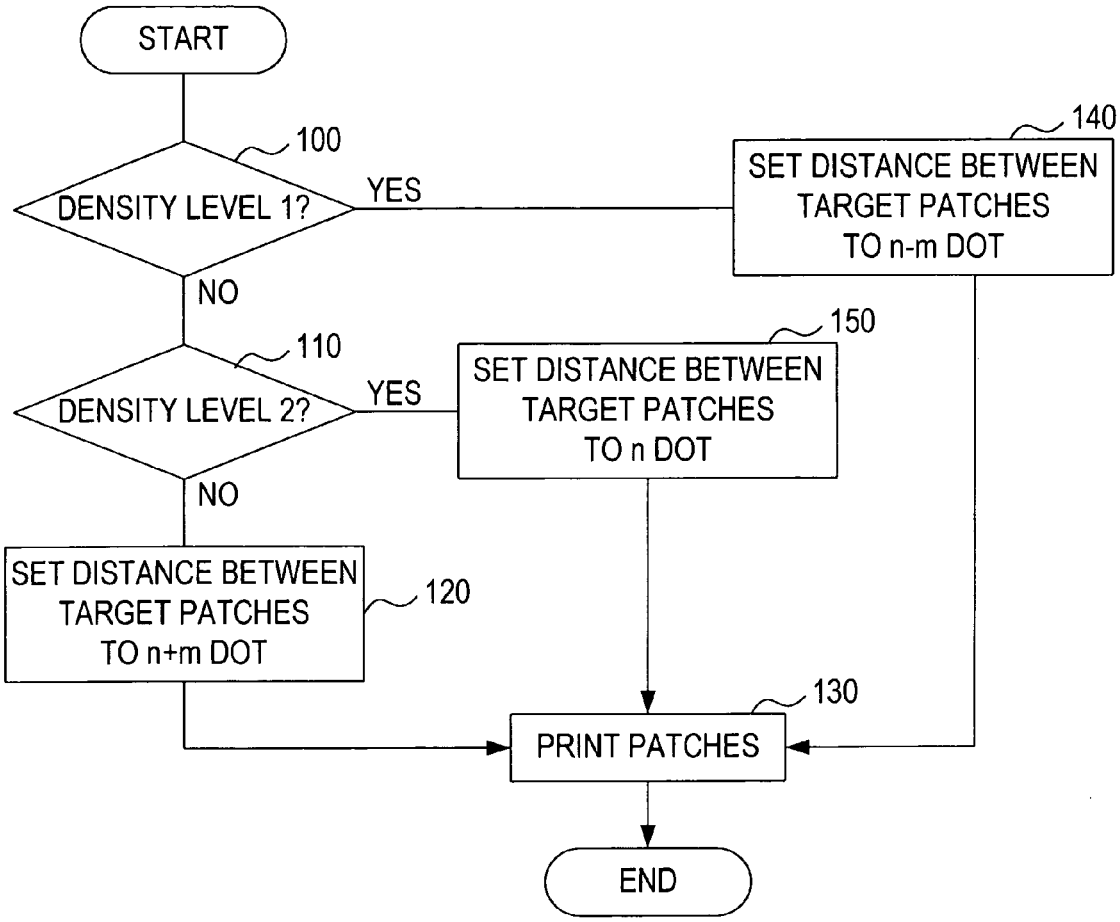
FIG. 10 is a flow chart showing a distance setting process between the target patches.

The constitution and operation of the color laser printer of the third embodiment is basically the same as in the first embodiment. However, the positions of the target patches 103*a* and 103*b* are changed by the control unit 67 in accordance with the density level at the time of forming the images of the target patches 103*a* and 103*b*. The details will be described with reference to FIG. 10. FIG. 10 is a flowchart showing a distance setting process of the target patches executed by the CPU 69.

In the step 100, whether or not the density of the target patches 103*a* and 103*b* is at level 1 is determined. The density of the target patches 103*a* and 103*b* is classified into three levels. The density becomes higher in order of level 1, level 2, and level 3. The user selects and sets the level through the input unit 81. When it is determined in the step 100 that the density is not at level 1, the procedure moves to the step 110. When it is determined that the density is at level 1, the procedure moves to the step 140.

In the step 110, whether or not the density of the target patches 103*a* and 103*b* is at level 2 is determined. When it is determined in the step 110 that the density is not at level 2, the procedure moves to the step 120. When it is determined that the density is at level 2, the procedure moves to the step 150.

In the step 120, n+m dot (n, m: natural number) is set as the distance between the target patches 103*a* and 103*b*.

In the step 130, the reference patches 101*a* and 101*b*, and the target patches 103*a* and 103*b*, are printed on the paper P.

When it is determined in the step 100 that the density is at level 1, n−m dot is set as the distance between the target patches 103*a* and 103*b* in the step 140. Then, in the step 130, the reference patches 101*a* and 101*b*, and the target patches 103*a* and 103*b*, are printed on the paper P.

When it is determined in the step 110 that the density is at level 2, n dot is set as the distance between the target patches 103*a* and 103*b* in the step 160. Then, in the step 130, the reference patches 101*a* and 101*b*, and the target patches 103*a* and 103*b*, are printed on the paper P.

In the third embodiment, as described above, the higher the density of the target patches 103*a* and 103*b* is, the larger the distance between the target patches 103*a* and 103*b* is set. Accordingly, without relying on the density of the target patches 103*a* and 103*b*, the positions of the target patches 103*a* and 103*b* with respect to the reference patches 101*a* and 101*b* can always be measured as the positions suitable for accurately calculating the positional deviation and magnification deviation among the different color images.

That is, the higher the density of the target patches 103*a* and 103*b* is, the more amount of toner is attached to the target patches 103*a* and 103*b*. Consequently, the target patches 103*a* and 103*b* expands toward the reference patches 101*a* and 101*b*. The distance between the target patches 103*a* and 103*b* becomes substantively short. Therefore, in the third embodiment, when the density of the target patches 103*a* and 103*b* is high, the distance between the target patches 103*a* and 103*b* is extended. In this manner, the effect due to the shortened distance between the target patches 103*a* and 103*b* is canceled by the effect caused by the extension of the distance between the target patches 103*a* and 103*b*. Accordingly, without relying on the density of the target patches 103*a* and 103*b*, the position where the overlap state is changed between the reference patch 101*a* and the target patch 103*b*, and the position where the overlap state is changed between the reference patch 101*b* and the target patch 103*b*, can always be measured as the positions suitable for accurately calculating the positional deviation and magnification deviation among the different color images.

Fourth Embodiment

Figure 11:
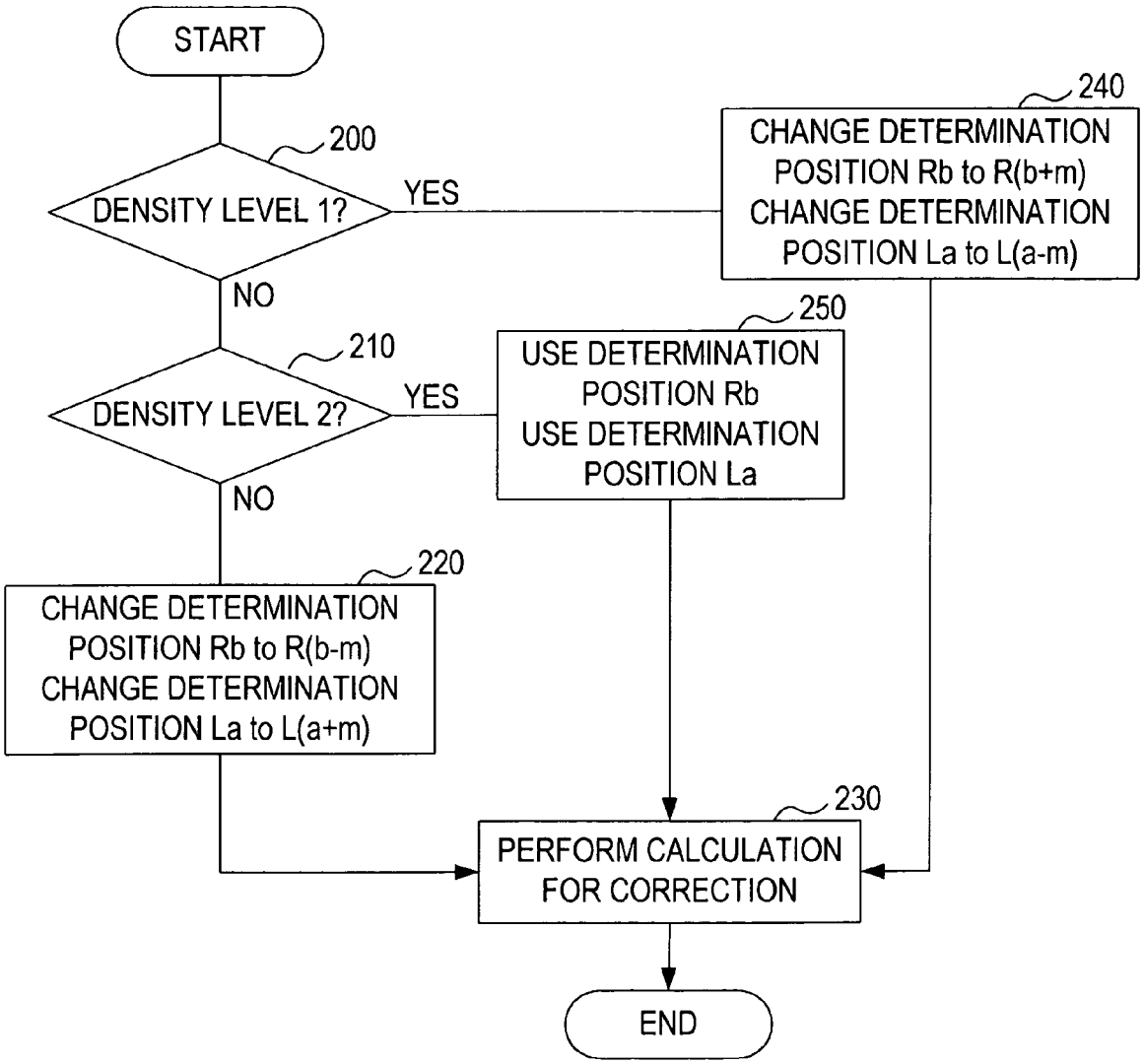
FIG. 11 is a flow chart showing a determination position correction process.

The constitution and operation of the color laser printer of the fourth embodiment is basically the same as in the first embodiment. However, in the fourth embodiment, the information inputted by the user through the input unit 81, based on the reference patches 101*a* and 101*b* and the target patches 103*a* and 103*b* formed on the paper P, is set as the information indicating the position where the overlap state is changed in the target patch 103*a* and the information indicating the position where the overlap state is changed in the target patch 103*b*. Also, in the fourth embodiment, the information indicating the position where the overlap state is changed in the target patch 103*a* and the information indicating the position where the overlap state is changed in the target patch 103*b* are corrected in accordance with the density level at the time of forming the images of the target patches 103*a* and 103*b*. The details will be described with reference to FIG. 11. FIG. 11 is a flowchart showing a determination position correction process executed by the CPU 69.

In the step 200, whether or not the density of the target patches 103*a* and 103*b* is at level 1 is determined. As in the third embodiment, the density of the target patches 103*a* and 103*b* becomes higher in order of level 1, level 2, and level 3. The user can input the level through the input unit 81. When the density is not at level 1, the procedure moves to the step 210. When the density is at level 1, the procedure moves to the step 240.

In the step 210, whether or not the density of the target patches 103*a* and 103*b* is at level 2 is determined. When the density is not at level 2, the procedure moves to the step 220. When the density is at level 2, the procedure moves to the step 250.

In the step 220, the positions where the overlap states between the reference patches 101*a* and 101*b* and the target patches 103*a* and 103*b* are corrected. Particularly, if the unit patch of the target patch 103*a* where the overlap state is changed is La (a: natural number from 1 to 23) (that is, for example, if the user determines that the overlap state is changed between the unit patch La and the unit patch L(a−1) or between the unit patch La and the unit patch L(a+1)), La which has been received through the input unit 81 is corrected to L(a+m) (m: natural number). If the unit patch of the target patch 103*b* where the overlap state is changed is Rb (b: natural number from 1 to 23) (that is, for example, if the user determines that the overlap state is changed between the unit patch Rb and the unit patch R(b−1) or between the unit patch Rb and the unit patch R(b+1)), Rb which has been received through the input unit 81 is corrected to R(b−m).

In the step 230, as in the first embodiment, the positional deviation and magnification deviation among the different color images are quantitatively detected, respectively, using the positions where the overlap states are changed after the correction. The control unit 67 corrects the first image forming device and the second image forming device based on these quantitatively detected values so as to cancel the positional deviation and magnification deviation.

When it is determined in the step 200 that the density is at level 1, the procedure moves to the step 240 so as to correct the positions where the overlap states are changed between the reference patches 101*a* and 101*b*, and the target patches 103*a* and 103*b*. Particularly, if the unit patch of the target patch 103*a* where the overlap state is changed is La (a: natural number from 1 to 23), La which has been received through the input unit 81 is corrected to L(a−m). If the unit patch of the target patch 103*b* where the overlap state is changed is Rb (b: natural number from 1 to 23), Rb which has been received through the input unit 81 is corrected to R(b+m). In the step 230, as in the first embodiment, quantitative detection of the positional deviation and magnification deviation among the different color images is performed using the positions where the overlap states are changed after the correction. The correction of the first image forming device and the second image forming device is also performed based on the detected values.

When it is determined in the step 210 that the density is at level 2, the procedure moves to the step 250. In the step 250, the unit patch where the overlap state is actually changed is set as La and Rb. In the step 230, as in the first embodiment, quantitative detection of the positional deviation and magnification deviation among the different color images is performed using the positions where the overlap states are changed after the correction. The correction of the first image forming device and the second image forming device is also performed based on the detected values.

In the fourth embodiment, the positions where the overlap states are changed between the reference patches 101*a* and 101*b*, and the target patches 103*a* and 103*b*, are corrected based on the density of the target patches 103*a* and 103*b*. Accordingly, without relying on the density of the target patches 103*a* and 103*b*, the positions of the target patches 103*a* and 103*b* with respect to the reference patches 101*a* and 101*b* can always be measured as the positions suitable for accurately calculating the positional deviation and magnification deviation among the different color images.

That is, when the density of the target patches 103*a* and 103*b* is lower (at level 1), the Sizes of the target patches 103*a* and 103*b* are smaller than the original sizes (sizes of the target patches 103*a* and 103*b* having the density at level 2). The positions where the overlap states are changed between the target patches 103*a* and 103*b*, and the reference patches 101*a* and 101*b*, are deviated from the positions of the target patches 103*a* and 103*b* having the density at level 2. That is, the reference number of the unit patch, of the target patch 103*a*, where the overlap state is changed becomes larger than the reference number of the unit patch of the target patch 103*a* having the density at level 2. The reference number of the unit patch, of the target patch 103*b*, where the overlap state is changed becomes smaller than the reference number of the unit patch of the target patch 103*b* having the density level at level 2. Therefore, in the fourth embodiment, in the step 240, the reference numbers of the unit patches where the overlap states are changed are corrected so as to cancel the influence caused by the sizes of the target patches 103*a* and 103*b* (by decreasing the reference number of the unit patch of the target patch 103*a*, and by increasing the reference number of the unit patch of the target patch 103*b*).

When the density of the target patches 103*a* and 103*b*. is higher (at level 3), the amount of toner attached to the target patches 103*a* and 103*b* becomes larger (toner gets thick). The sizes of the target patches 103*a* and 103*b* become larger than the original sizes (sizes of the target patches 103*a* and 103*b* having the density at level 2). The positions where the overlap states are changed between the target patches 103*a* and 103*b*, and the reference patches 101*a* and 101*b*, are deviated from the positions of the target patches 103*a* and 103*b* having the density at level 2. That is, the reference number of the unit patch, of the target patch 103*a*, where the overlap state is changed becomes smaller than the reference number of the unit patch of the target patch 103*a* having the density at level 2. The reference number of the unit patch, of the target patch 103*b*, where the overlap state is changed becomes larger than the reference number of the unit patch of the target patch 103*b* having the density at level 2. Therefore, in the fourth embodiment, in the step 220, the reference numbers of the unit patches where the overlap states are changed are corrected so as to cancel the influence caused by the sizes of the target patches 103*a* and 103*b* (by increasing the reference number of the unit patch of the target patch 103*a*, and by decreasing the number of the unit patch of the target patch 103*b*).

Fifth Embodiment

Figure 12:
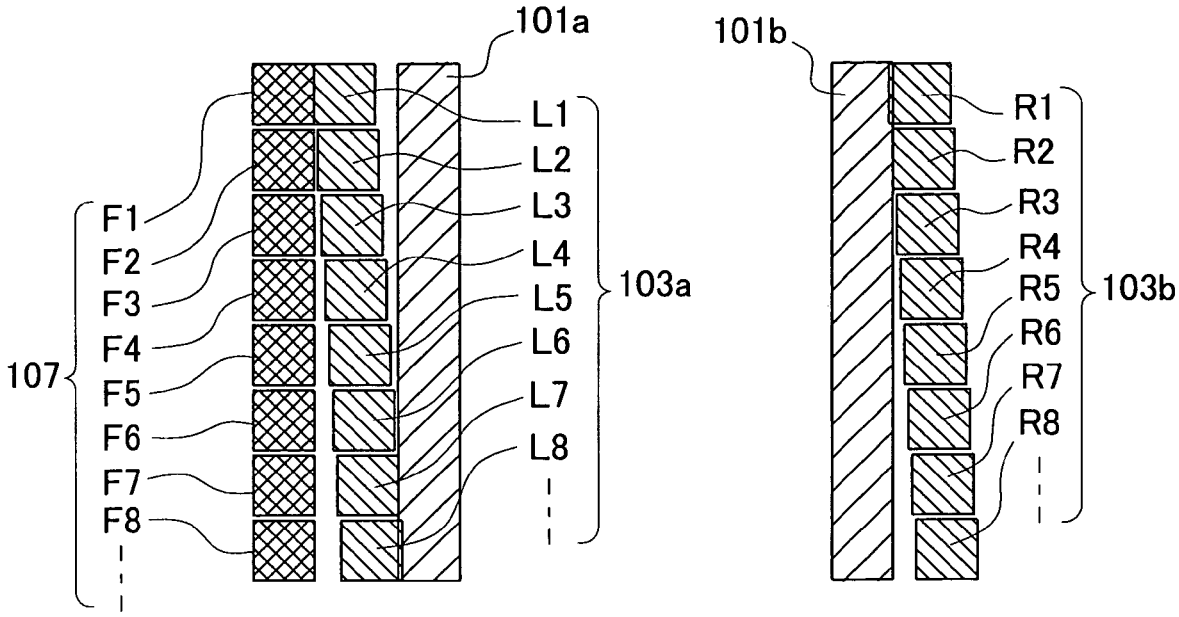
FIG. 12 is a configuration of a toner amount detection patch.

The constitution and operation of the color laser printer of the fifth embodiment is basically the same as in the first embodiment. However, in the fifth embodiment, the photoconductor drum 15C, the charging unit 19C, the exposing device 21C, and the cyan image developing unit 13C (the second image forming device), for forming the cyan image, prints a toner amount detection patch 107 on the paper P, in addition to the target patches 103*a* and 103*b* as illustrated in FIG. 12.

The toner amount detection patch 107 is constituted by rectangular unit patches F1 to F23. The unit patches F1 to F23 are disposed on the left sides of the unit patches L1 to L23 constituting the target patch 103*a*. The unit patches F1 to P23 and L1 to L23 are arranged so that the larger the reference number is, the wider the distance is between the unit patches F1 to F23 and the unit patches L1 to L23 by 1 dot. That is, the, distance between the unit patches P1 and L1 is 0 dot, the distance between the unit patches F2 and L2 is 1 dot, and the distance between the unit patches F3 and L3 is 2 dots, and so on.

When the density of the target patches 103*a* and 103*b*, and the toner amount detection patch 107 as the cyan images, is high, the toner amount attached to the patches is increased. As a result, the toner amount detection patch (toner amount detection patch A) 107 and the target patch 103*a* (toner amount detection patch B) are connected even at the position where the distance therebetween is essentially large. Conversely, when the density of the target patches 103*a* and 103*b*, and the toner amount detection patch, is low, the toner amount attached to the patches is reduced. As a result, the toner amount detection patch 107 and the target patch 103*a* are not connected even at the position where the distance therebetween is essentially small (for example, even between the unit patch F1 and the unit patch L1).

Therefore, in the fifth embodiment, the toner amount attached to the target patches 103*a* and 103*b* can be detected by detecting the position where the target patch 103*a* and the toner amount detection patch 107 are connected.

As in the fourth embodiment, the positions where the overlap states are changed between the reference patches 101*a* and 101*b*, and the target patches 103*a* and 103*b*, are corrected based on the detected toner amount attached to the target patches 103*a* and 103*b*. The positional deviation and magnification deviation can be more precisely calculated.

For example, the user inputs, through the input unit 81, the information specifying the unit patch positioned where the overlap state is changed from the connected state to the separate state between the unit patches F1 to F23 and the unit patches L1 to L23 (unit patch F2 if the respective patches are formed as shown in FIG. 12), in addition to the information La indicating the position where the overlap state is changed between the target patch 103*a* and the reference patch 101*a*, and the information Rb indicating the position where the overlap state is changed between the target patch 103*b* and the reference patch 101*b*.

In this case, the CPU 69, based on the received information specifying the unit patch positioned where the overlap state is changed from the connected state to the separate state between the unit patches F1 to F23 and the unit patches L1 to L23, executes a process corresponding to either one of the steps 220, 240, and 260 so as to appropriately correct the La and Rb.

Then, the CPU 69 executes the procedure corresponding to the step 230, so as to quantitatively detect the respective positional deviation and magnification deviation among the different color images. Also, the correction of the first image forming device and the second image forming device is performed based on the detected values.

In the fifth embodiment, the target patches 103*a* and 103*b*, and the toner amount detection patch 107, are both printed using the constitution for forming a cyan image (the second image forming device). However, while the target patches 103*a* and 103*b* are printed using the constitution for forming a cyan image (second image forming device), the toner amount detection patch 107 may be printed using the constitution for forming a magenta image (the first image forming device) or the constitution for forming other color images (yellow or black).

Sixth Embodiment

The constitution and operation of the color laser printer of the sixth embodiment is basically the same as in the first embodiment. However, in the sixth embodiment, the relationship of the reference patch and the target patch against the main and sub-scanning directions is opposite to the relationship in the first embodiment. Only one pair of the reference patch and the target patch is formed.

Figure 13:
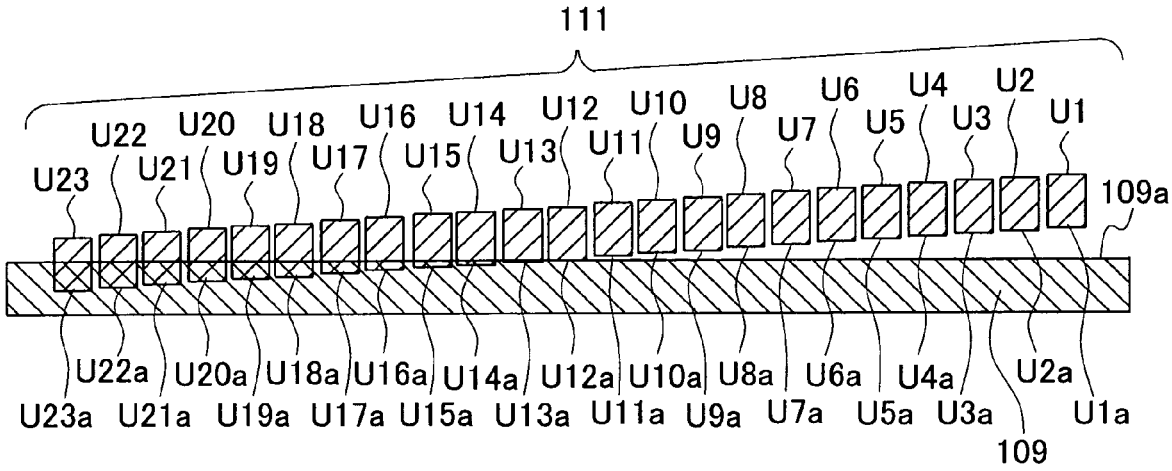
FIG. 13 is an explanatory view of a reference patch and a target patch.

Particularly, in the sixth embodiment, as illustrated in FIG. 13, only one reference patch 109, whose longitudinal direction is parallel to the main-scanning direction, is formed. The target patch 11 is constituted by rectangular unit patches U1 to U23 which are arranged along the main scanning direction above the reference patch 109. The border sections U1*a* to U23*a*, as the bottom border lines of the unit patches U1 to U23, are straight lines parallel to the main scanning direction. The larger the reference number of each of the border sections U1*a* to U23*a* is, the more downward each of the border sections U1*a* to U23*a* is shifted by 1 dot. That is, the border section L(i+1)a is downwardly shifted by 1 dot, compared to the border section L1*a* (i: integer number from 1 to 22).

In the sixth embodiment, the position where the positions of the border sections 101*a* to U23*a* of the target patch 111 are changed from above the border section 109*a*, which is the top border line of the reference patch 109, to below the border section 109*a*, can be defined as the position where the overlap state is changed. The position where the overlap state is changed varies corresponding to the position of the target patch 111 in the sub-scanning direction with respect to the reference patch 109.

Therefore, in the sixth embodiment, occurrence of the positional deviation in the sub-scanning direction and magnification deviation of the target patch 111 (cyan image) with respect to the reference patch 109 (magenta image) can be detected based on the position where the overlap state between the reference patch 109 and the target patch 111 is changed.

The present embodiment is not to be limited to the embodiments described above, and modifications and substitutions by one of ordinary skill in the art are considered to be within the scope of the present invention.

For example, the color of the reference patch and the target patch can be arbitrarily selected as any two color combination of magenta, cyan, yellow, and black. Therefore, in the present invention, the positional deviation and magnification deviation can be detected with respect to the arbitrary combination among the images formed by the four colors.

Figure 14:
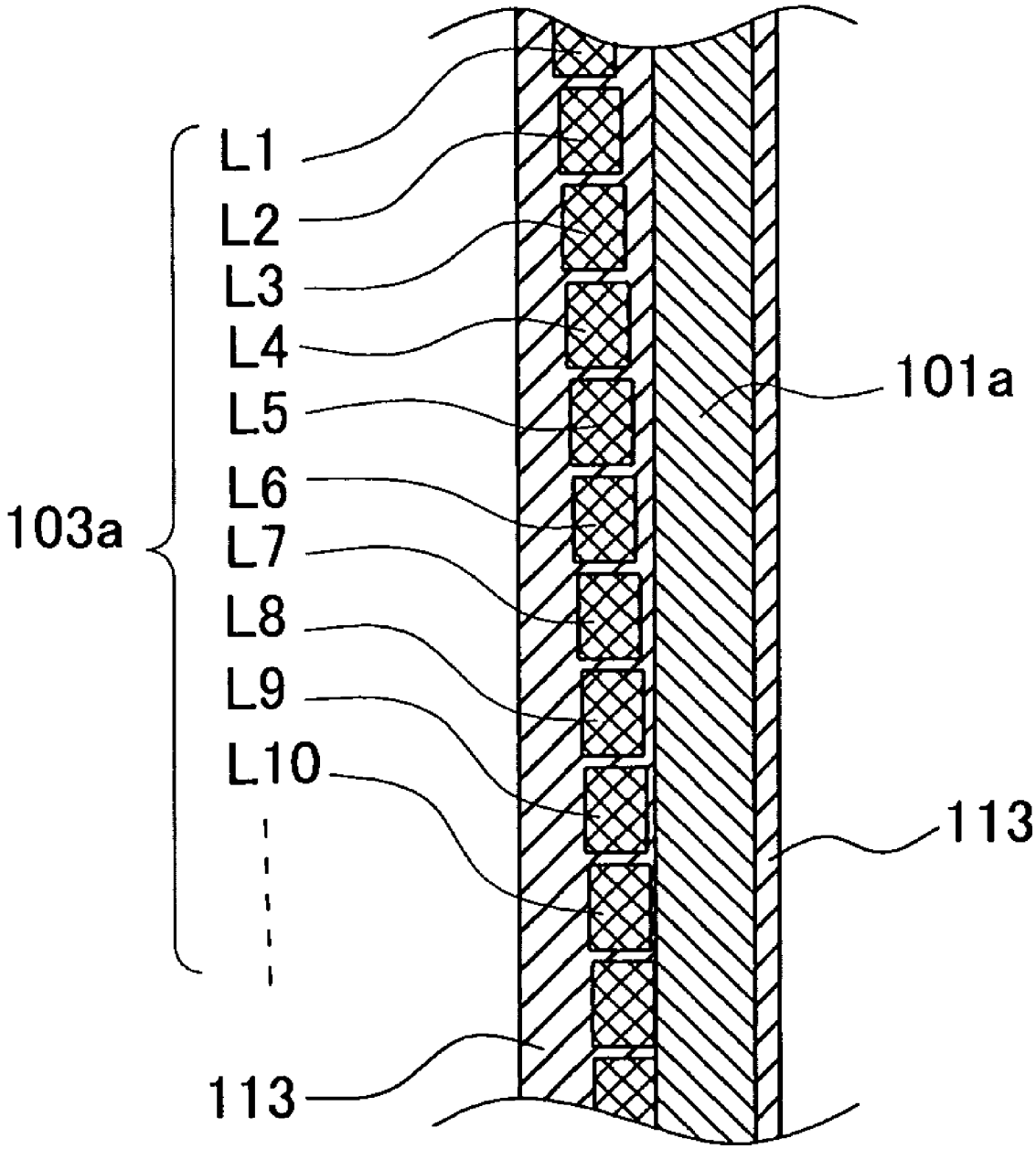
FIG. 14 is an explanatory view describing a case in which a reference patch and a target patch are formed and an area surrounding the reference patch and the target patch is painted.

When either the reference patch or the target patch is yellow, the border line of the patch may be unclear on the white paper P. In this case, as illustrated in FIG. 14, the area surrounding the reference patch and the target patch can be filled with the color (for example, cyan) which is not used for the reference patch and the target patch. Accordingly, the yellow patch can be visualized as green, and the border line becomes clear. Therefore, the positional deviation and magnification deviation can be detected precisely.

In the first to sixth embodiments, the position where the overlap state is changed is not limited to the position "where the patches are firstly connected". For example, it may be other positions, such as the position "where the patches are firstly separated", the position "where all of a part of the target patch is included in the reference patch", or the position "where a part of the target patch firstly protrudes from the included state".

Particularly, the position where the overlap state is changed may be at least one of the positions, "where the state is changed from a non-overlapping state to an overlapping state", "where the state is changed from an overlapping state to a non-overlapping state", "where the state is changed from a non-contacting state to a contacting state", and "where the state is changed from a contacting state to a non-contacting state", between the reference patch and the target patch.

Also, the position where the overlap state is changed may be at least one of the positions, where the position of the border section of the target patch is changed "from the position outside the reference patch (non-painted area) to the position inside the reference patch (painted area)", "from the position inside the reference patch to the position outside the reference patch", "from the position outside the reference patch to the position abutting the border section of the reference patch", and "from the position inside the reference patch to the position abutting the border section of the reference patch".

Moreover, in the sixth embodiment, only the combination of the reference patch 109 and the target patch 111 is formed. However, as shown in FIG. 15, the combination of the reference patch 109 and the target patch 111 and the combination of the reference patch 113 and the target patch 115 may be formed respectively so that an interval in the sub-scanning direction is left between the combinations.

Figure 15:
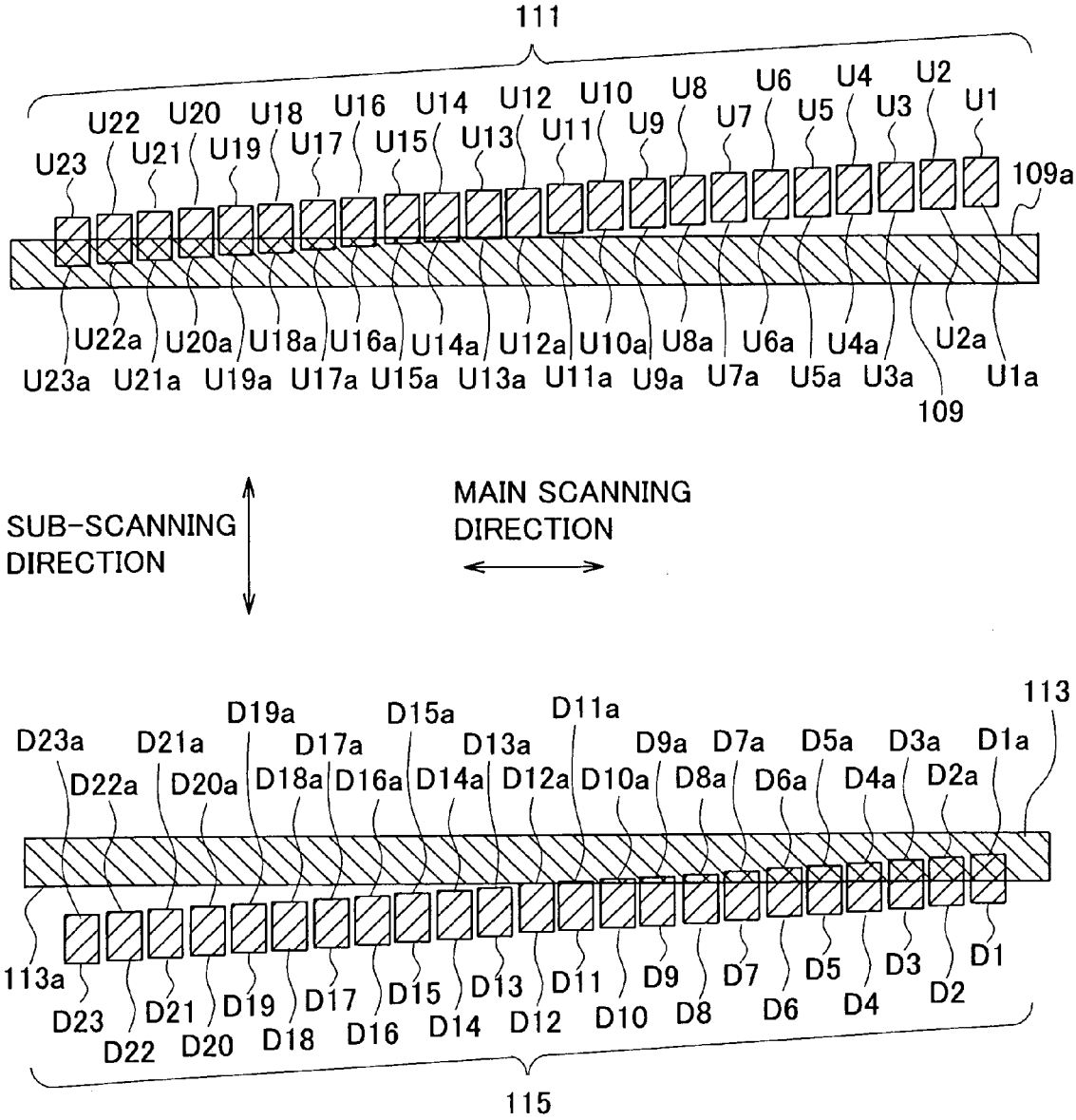
FIG. 15 is an explanatory view of reference patches and target patches.

The patches shown in FIG. 15 are corresponding to the patches shown in FIG. 3 rotated by 90°. Accordingly, in the case of FIG. 15, the positional deviation in the sub-scanning direction and magnification deviation among the different color images can be quantitatively detected by detecting and using the information indicating the position where the overlap state is changed between the target patch 111 and the reference patch 109 and the information indicating the position where the overlap state is changed between the target patch 115 and the reference patch 113.

Figure 16:
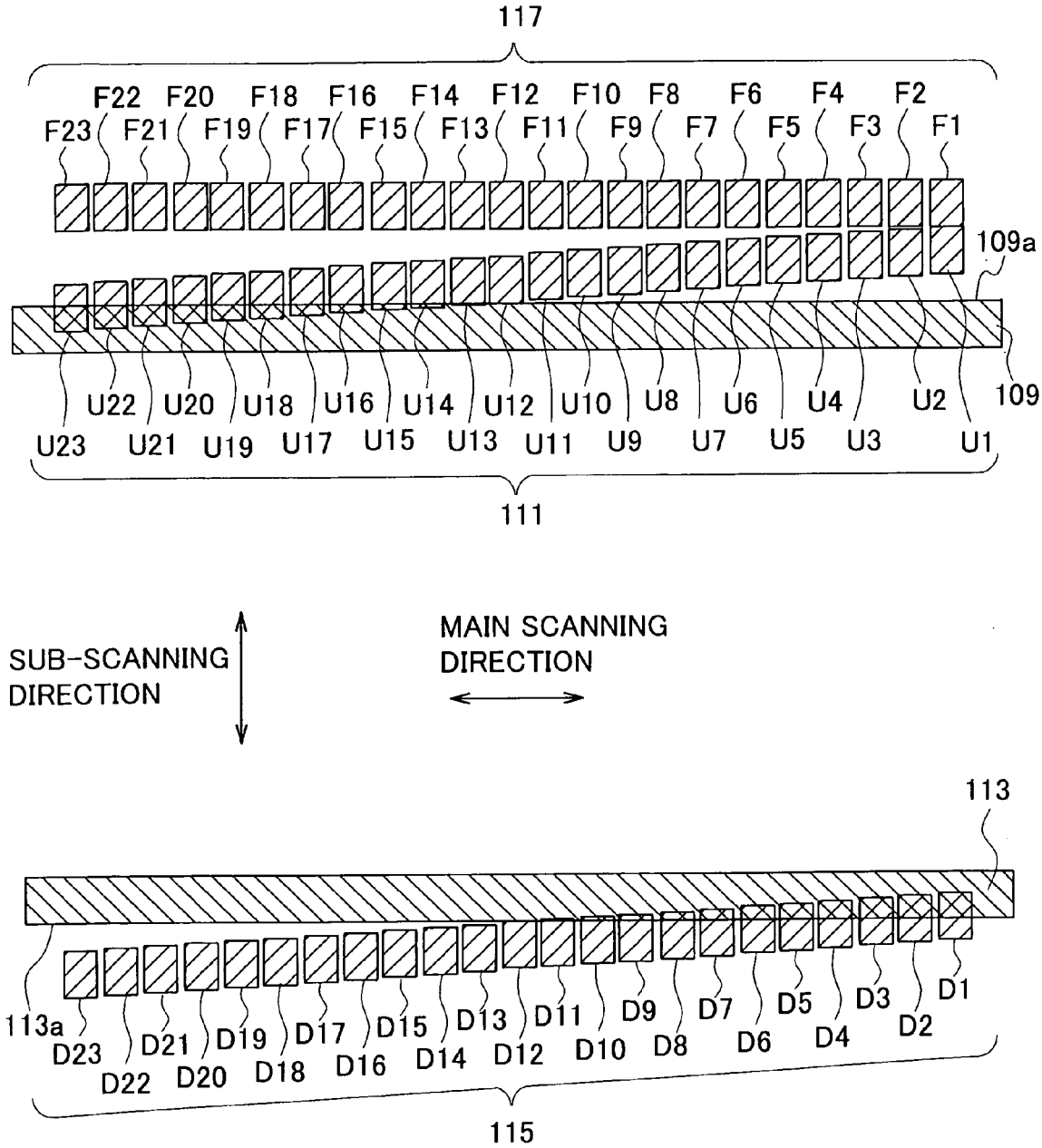
FIG. 16 is an explanatory view of a configuration of a toner amount detection patch.

Furthermore, in the case where the patches are formed as shown in FIG. 15, the toner amount detection patch (toner amount detection patch A) 117 may be formed as shown in FIG. 16.

The toner amount detection patch 117 is constituted from rectangular unit patches F1 to F23. The unit patches F1 to P23 are respectively disposed above the unit patches U1 to U23 constituting the target patch 111. The unit patches F1 to F23 and the unit patches U1 to U23 are arranged so that the distance therebetween is increased by 1 dot as the reference number of the unit patch is increased. That is, the distance between the unit patch F1 and the unit patch U1 is 0 dot, the distance between the unit patch F2 and the unit patch U2 is 1 dot, the distance between the unit patch F3 and the unit patch U3 is 2 dot, and so on.

When the density of the target patches 111 and 115, and the toner amount detection patch 117, as the same single color images, is changed, the reference number of the unit patch positioned where the relationship between the unit patches F1 to F23 and the unit patches U1 to U23 is changed from a connected state to a separate state is also changed.

In this case, the user may input, through the input unit 81, the information specifying a unit patch positioned where the relationship between the unit patches F1 to F23 and the unit patches U1 to U23 is changed from the connected state to the separate state (the unit patch F2 if the respective patches are formed as in FIG. 16), in addition to the information Ua indicating the position where the overlap state is changed between the target patch 111 and the reference patch 109 and the information Da indicating the position where the overlap state is changed between the target patch 115 and the reference patch 113.

In this case, the CPU 69, based on the received information specifying the unit patch positioned where the relationship is changed from the connected state to the separate state between the unit patches F1 to F23 and the unit patches U1 to U23, may execute a process corresponding to either one of the steps 220, 240, and 250 so as to appropriately correct the information Ua indicating the position where the overlap state is changed between the target patch 111 and the reference patch 109 and the information Da indicating the position where the overlap position is changed between the target patch 115 and the reference patch 113.

Accordingly, the CPU 69 can then execute the procedure corresponding to the step 230, so as to quantitatively detect the respective positional deviation in the sub-scanning direction and magnification deviation among the different color images. Also, the correction of the first image forming device and the second image forming device can be accurately performed based on the detected values.

The target patches 111 and 115, and the toner amount detection patch 117, may be different color images.

Figure 17:
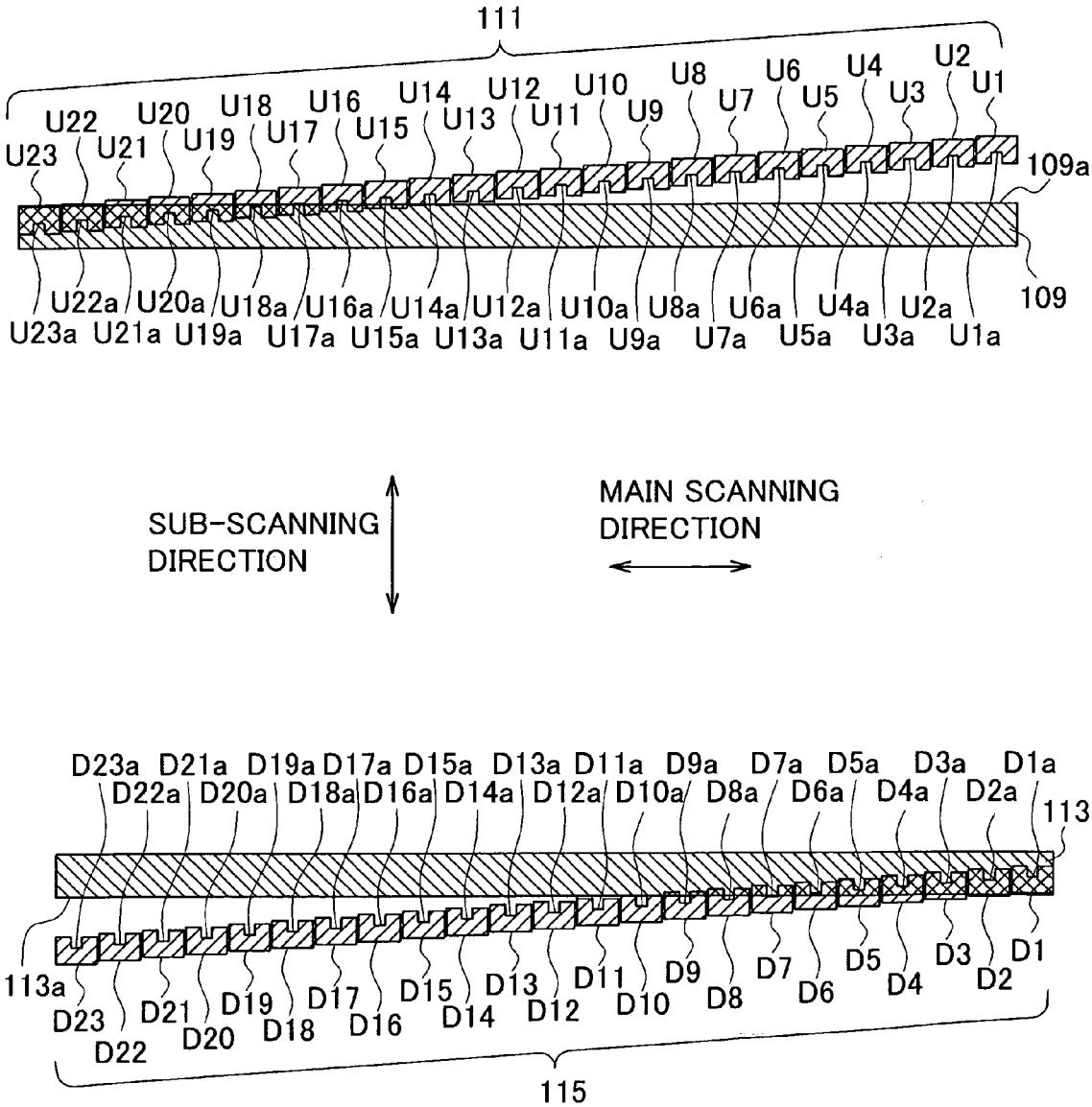
FIG. 17 is an explanatory view of reference patches and target patches.

Moreover, the target patches 111 and 115 shown in FIG. 15 may comprise the U-shaped unit patches U1 to U23 and D1 to D23, respectively, as shown in FIG. 17.

The patches shown in FIG. 17 are corresponding to the patches shown in FIG. 8 rotated by 90°. Accordingly, in the case of FIG. 17, the respective positional deviation in the sub-scanning direction and magnification deviation among the different color images can be quantitatively detected, by detecting and using the information indicating the position where the overlap state is changed between the target patch 111 and the reference patch 109 and the information indicating the position where the overlap position is changed between the target patch 115 and the reference patch 113.

The information used for such detection are, for example, the information indicating the position where the state is changed from the state where the non-painted area is remained inside the concave portion, to the state where there is no non-painted area inside the concave portion, in the U-shaped unit patches U1 to U23, and the information indicating the position where the state is changed from the state where there is no non-painted area inside the concave portion, to the state where the non-painted area is remained inside the concave portion, in the unit patches D1 to D23.

What is claimed is:

1. An image forming apparatus, comprising:

a first image forming device that forms an image using a first color toner;

a second image forming device that forms an image using a second color toner; and a control device that controls the first image forming device and the second image forming device, wherein the control device controls the first image forming device and the second image forming device, so that at least one reference patch whose specified area is painted in the first color toner is formed by the first image forming device and at least one target patch whose specified area is painted in the second color toner is formed by the second image forming device, and a part of the reference patch and a part of the target patch are overlapped and a position where an overlap state between the reference patch and the target patch is changed varies in accordance with a change in a position in a first direction of a target patch forming position with respect to a reference patch forming positions, wherein the reference patch includes a reference patch border section as a border line approximately parallel to a second direction perpendicular to the first direction, the target patch includes a plurality of target patch border sections as border lines approximately parallel to the second direction, the plurality of target patch border sections being arranged so that positions of the plurality of the target patch border sections in the first direction and the second direction are shifted among plurality of the target patch border sections, and at least one target patch border section of the plurality of the target patch border sections is positioned on one side of the reference patch border section, at least one target patch border section, except the at least one target patch border section positioned on one side of the reference patch border section, is positioned on one of the reference patch border section and on the other side opposite to the one side of the reference patch border section.

2. The image forming apparatus according to claim 1, wherein the position where the overlap state is changed is at least one of positions where the overlap state between the reference patch and the target patch is changed from a non overlapping state to an overlapping state, from an overlapping state to a non overlapping state, from a non contacting state to a contacting state, and from a contacting state to a non contacting state.

3. The image forming device according to claim 1, wherein the first direction is a main scanning direction.

4. The image forming apparatus according to claim 1, wherein the first direction is a sub-scanning direction.

5. The image forming apparatus according to claim 1, wherein the reference patch includes an area that is painted in the first color toner on one side of the reference patch border section and an area that is not painted in the first color toner on the other side opposite to the one side of the reference patch border section, and the position where the overlap state is changed is a position between two of the target patch border sections of the plurality of the target patch border sections, and the position where the overlap state is changed is at least one of positions where position of the target patch border section is changed from a non-painted area to a painted area, from a painted area to a non-painted area, from a non-painted area to a position contacting with the reference patch border section, and from a painted area to a position contacting with the reference patch border section.

6. The image forming apparatus according to claim 1, wherein the control device drives the first image forming device and the second image forming device to form two pairs of the reference patch and the target patch corresponding to the reference patch so that an interval in the first direction is left between the two pairs.

7. The image forming apparatus according to claim 1, wherein the control device drives the first image forming device and the second image forming device to form two pairs of the reference patch and the target patch corresponding to the reference patch so that an interval in the first direction is left between the two pairs, and in each pair of the two pairs of the reference patch and the target patch, the reference patch comprises the reference patch border section as an outside border line on a side opposite to the other reference patch.

8. The image forming apparatus according to claim 1, wherein the first direction is a main scanning direction and the second direction is a sub-scanning direction.

9. The image forming apparatus according to claim 8, wherein the reference patch border section is a straight line parallel to the sub-scanning direction.

10. The image forming apparatus according to claim 8, wherein the target patch border section is a straight line parallel to the sub-scanning direction.

11. The image forming apparatus according to claim 1, wherein the first direction is a sub-scanning direction and the second direction is a main scanning direction.

12. The image forming apparatus according to claim 11, wherein the reference patch border section is a straight line parallel to the main scanning direction.

13. The image forming apparatus according to claim 11, wherein the target patch border section is a straight line parallel to the main scanning direction.

14. The image forming apparatus according to claim 1, wherein the control device controls the first image forming device and the second image forming device so as to form at least one toner amount detection patch A whose specified area is painted and at least one toner amount detection patch B whose specified area is painted, and a distance between the toner amount detection patch B and the toner amount detection patch A in the first direction is changed by a specified amount along a second direction perpendicular to the first direction.

15. The image forming apparatus according to claim 1, wherein the control device controls the second image forming device so as to form at least one toner amount detection patch A whose specified area is painted with the second color toner and at least one toner amount detection patch B whose specified area is painted with second color toner, and a distance between the toner amount detection patch B and the toner amount detection patch A in the first direction is changed by a specified amount along a second direction perpendicular to the first direction.

16. The image forming apparatus according to claim 15, wherein the positional relationship between the toner amount detection patch A and the toner amount detection patch B in the first direction is changed from one of an overlapping state and a contacting state, to a separate state in which the distance between the toner amount detection patch B and the toner amount detection patch A is extended by a specified amount along the second direction.

17. The image forming apparatus according to claim 6, comprising:

a density information preservation unit that preserves a density setting information of the target patches formed by the second image forming device, wherein the control device sets a distance between the target patch of one pair of the two pairs of the reference patch and the target patch, and the target patch of the other pair, in accordance with a density setting information preserved by the density information preservation unit, and the control device drives the first image forming device and the second image forming device based on the set distance to form the two pairs of the reference patch and the target patch.

18. The image forming apparatus according to claim 1, comprising:

an input device that inputs information on a position where the overlap state is changed; and a density information preservation unit that preserves a density setting information of the target patch formed by the second image forming device, wherein the control device corrects the information on the position where the overlap state is changed inputted through the input device in accordance with the density setting information preserved by the density information preservation unit.

19. The image forming apparatus according to claim 1, further comprising:

a third image forming device that forms an image using a third color toner, wherein the control device controls the third image forming device, so that at least one patch, whose area surrounding the reference patch and the target patch is painted, is formed by the third image forming device.

20. An image forming apparatus, comprising:

a first image forming device that forms an image using a first color toner;

a second image forming device that forms an image using a second color toner; and a control device that controls the first image forming device and the second image forming device, wherein the control device controls the first image forming device and the second image forming device, so that at least one reference patch whose specified area is painted in the first color toner is formed by the first image forming device and at least one target patch whose specified area is painted in the second color toner is formed by the second image forming device, and a part of the reference patch and a part of the target patch are overlapped and a position where an overlap state between the reference patch and the target patch is changed varies in accordance with a change in a position in a first direction of a target patch forming position with respect to a reference patch forming position, wherein the target patch includes a plurality of U-shaped patches, and each of the U-shaped patches comprises a concave portion opened in a direction parallel to the first direction, and bottom sections of the concave portions in the plurality of U-shaped patches are arranged as the plurality of target patch border sections and positions of plurality of the bottom sections in the first direction are shifted among plurality of the bottom sections.

* * * * *